US007367293B2

(12) United States Patent
Takeuchi

(10) Patent No.: US 7,367,293 B2
(45) Date of Patent: May 6, 2008

(54) FOUR-STROKE ENGINE

(75) Inventor: Yoshihiko Takeuchi, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 10/858,705

(22) Filed: Jun. 2, 2004

(65) Prior Publication Data

US 2004/0244735 A1 Dec. 9, 2004

(30) Foreign Application Priority Data

Jun. 3, 2003 (JP) ..... 2003-158475
Apr. 5, 2004 (JP) ..... 2004-111199

(51) Int. Cl.
*F01P 9/04* (2006.01)

(52) U.S. Cl. ..... 123/41.57

(58) Field of Classification Search ..... 123/41.72, 123/41.69, 41.14, 41.15, 41.05, 41.43, 41.44, 123/41.57
See application file for complete search history.

(56) References Cited

U.S. PATENT DOCUMENTS 2,405,847 A * 8/1946 Pullin ..... 123/41.81
3,983,852 A * 10/1976 Chatourel ..... 123/41.69
4,009,693 A * 3/1977 Bailey et al. ..... 123/41.82 A
4,768,484 A * 9/1988 Scarselletta ..... 123/41.21
4,889,079 A * 12/1989 Takeda et al. ..... 123/41.82 R
5,065,707 A * 11/1991 Elsbett et al. ..... 123/41.42
5,983,843 A * 11/1999 Suzuki et al. ..... 123/41.82 R
6,167,848 B1 * 1/2001 Frantzheld ..... 123/41.79
6,708,652 B2 * 3/2004 Oki ..... 123/41.49
6,823,823 B2 * 11/2004 Kim ..... 123/41.74
6,827,049 B2 * 12/2004 Oh ..... 123/41.82 R
2002/0029752 A1 * 3/2002 Laimbock ..... 123/41.57

FOREIGN PATENT DOCUMENTS

JP 06-96975 11/1994
JP 2649179 5/1997

* cited by examiner

*Primary Examiner*—Stephen K. Cronin
*Assistant Examiner*—Jason Benton
(74) *Attorney, Agent, or Firm*—Hogan & Hartson LLP

(57) ABSTRACT

A four-stroke engine includes a cylinder block, a cylinder head mounted on the cylinder block, multiple cooling fins formed on the cylinder block and the cylinder head, a combustion chamber and an intake port and exhaust port formed in the cylinder head and in communication with the combustion chamber. A cooling jacket is formed in the cylinder head only between a virtual object generated by the intake port or exhaust port being rotated about a cylinder axis. A mating surface of the cylinder head on the cylinder block.

14 Claims, 24 Drawing Sheets

FOUR-STROKE ENGINE

BACKGROUND OF THE INVENTION

1. Field of the Invention

This invention relates to a four-stroke engine for a motorcycle.

2. Description of Related Art

A conventional type of water-cooled engine uses a structure having a cooling jacket for surrounding peripheries around a combustion chamber of a cylinder head and a cylinder in a cylinder block in order to ensure even temperature distribution. However, the heat load is not distributed evenly over the peripheries around the combustion chamber and the cylinder. Therefore, some areas are overcooled.

A water-cooled engine has a cooling system with a maximum heat radiation performance, that is, sizes of a radiator and a water pump, designed such that a long life coolant (LCC) as a refrigerant exceeds not more than a preset boiling point. Thus, the sizes of the radiator and the water pump tend to be designed large enough, or even overlarge, relative to a desired temperature in areas to be cooled.

A type of water-cooled engine, which has a cooling jacket formed on the cylinder head and the cylinder block, and cooling fins, as well as another type, which supplies cooling wind by a cooling fan to areas around the cylinder head and the cylinder block, are known.

In contrast to that, an air-cooled engine cannot be needed to have the radiator, water pump and cooling water line. This allows the engine size to be reduced while improving design flexibility in the engine and the body.

The air-cooled engine functions well except in the case of an extremely high heat load. The engine has a problem with an abnormal rise in temperature especially around an exhaust port, as the engine displacement increases, affecting the engine's output to some extent.

The air-cooled engine may additionally have a partial water cooling system for water cooling an area subject to an extremely high heat load. This type of air-cooled engine requires auxiliary devices such as the radiator and water pump to be disposed. This may cause an increase in the size of the engine, and limit the design flexibility specific to the air-cooled engine, depending on a predetermined area to be water-cooled, a size of each auxiliary device, and their arrangement.

In view of the foregoing, an advantage of this invention is to provide a four-stroke engine which can prevent an increase in size of the engine with a water cooling system, and ensure design flexibility in the engine and body.

SUMMARY OF THE INVENTION

According to an embodiment of the present invention, a four-stroke engine includes a cylinder block, a cylinder head mounted on the cylinder block, multiple cooling fins formed on the cylinder block and the cylinder head, a combustion chamber and an intake port and exhaust port formed in the cylinder head and in communication with the combustion chamber. A cooling jacket is formed in the cylinder head only between a virtual object generated by the intake port or exhaust port being rotated about a cylinder axis and a mating surface of the cylinder head on the cylinder block side.

The cooling jacket is formed, surrounding an outer peripheral portion of the combustion chamber viewed in a cylinder axis direction.

Also, the cooling jacket is formed in the cylinder head between a bottom surface of the exhaust port and a mating surface on the cylinder block side.

The cylinder head has an overhang portion formed at an end on the cylinder block side and protruding outward from a cylinder of the cylinder block in a radial direction of the cylinder. The overhang portion has a water port for the cooling jacket formed on its undersurface, the water port is connected to a water pipe, and the water pipe is disposed approximately in parallel to the cylinder axis.

The water pipe is disposed close to the cylinder axis such that part of the water pipe is positioned within the cooling fin.

A mechanical pump driven for rotation by a crankshaft circulates cooling water between the cooling jacket and a radiator during engine operation, and a motor-driven pump circulates cooling water in the cooling jacket for a given time at a time the engine stops.

Cooling water in the cooling jacket is circulated such that it bypasses the radiator at the time the engine stops.

The radiator is disposed such that an upper end portion of the radiator is positioned at a height corresponding to a lower end of the cylinder block when viewed from the front of a vehicle.

The radiator is disposed under a seat of a motorcycle, and vehicle components are disposed in the front of and in the rear of as well as on a left and right side of the radiator.

According to an embodiment of the present invention, the four-stroke engine includes a cooling jacket and a radiator, and circulating cooling water between the cooling jacket and the radiator. A mechanical pump driven for rotation by a crankshaft circulates cooling water between the cooling jacket and the radiator during engine operation. A motor-driven pump circulates cooling water in the cooling jacket for a given time at a time the engine stops.

Cooling water in the cooling jacket is circulated such that it bypasses the radiator at the time the engine stops.

In the four-stroke engine according to the present invention, the cooling jacket is formed in the cylinder head only between a virtual object generated by the intake port or exhaust port being rotated about the cylinder axis, and the mating surface on the cylinder block side, that is, in an area of the cylinder head subject to the highest heat load. Therefore, a region around the exhaust port and the outer peripheral portion of the combustion chamber subject to an extremely high heat load can be partially cooled with cooling water, while mainly utilizing air cooling, thereby securing necessary cooling performance independent of the engine displacement.

With minimum water cooling in the area subject to an extremely high heat load, small and lightweight auxiliary devices, such as a radiator and water pump, can be used. This can also prevent a water-cooled engine from having an over large cooling system, which differs from the conventional type of water-cooled engines, while preventing an increase in size of the engine provided with an additional partial water cooling system. Furthermore, design flexibility in the engine and body can be ensured.

In the present invention, the cooling jacket surrounds the peripheral portion of the combustion chamber. The cooling jacket is formed between the bottom surface of the exhaust port and the mating surface on the cylinder block side. This allows partial cooling in the area subject to an extremely high heat load and prevents an increase in the size of the engine. Furthermore, design flexibility in the air-cooled engine can be ensured.

The cylinder head has the overhang portion formed at the end on the cylinder block side and the water pipe is connected to the water port formed in the overhang portion and disposed approximately in parallel to the cylinder axis. This prevents the water pipe from protruding outward of the engine and allows water supply with a simple and compact structure although the cooling jacket is not provided on the cylinder block but only on the cylinder head. In other words, when the cooling jacket is formed, passing such that the cylinder block and the cylinder head can be in communication with each other, the water supply may be allowed around the lower end of the cooling jacket on the cylinder block side. This causes no problem with the water supply structure. However, the water supply structure for the cooling jacket provided only on the cylinder head may affect the external appearance of the engine, which is considered crucial for this type of engine. The appearance of the branch pipe of the present invention looks like a cover pipe for housing push rods so that it neither stands out nor deteriorates the external appearance of the engine.

The water pipe is disposed close to the cylinder axis such that part of the water pipe is positioned within the cooling fins. This can more reliably prevent the water pipe from protruding outward of the engine and allows the water supply with a simple and compact structure although the cooling jacket is not provided on the cylinder block but only on the cylinder head.

The mechanical pump driven for rotation by the engine circulates cooling water between the cooling jacket and the radiator. This can ensure a required amount of cooling water circulation in a high speed and high load operating range of the engine, thereby securing a necessary cooling performance.

In addition to the mechanical pump, the motor-driven pump is also provided for circulating cooling water in the cooling jacket for a given time at the time the engine stops. When the engine stopping causes the mechanical pump to stop, the motor-driven pump circulates cooling water in the cooling jacket, thereby preventing the cooling water from boiling.

Cooling water in the cooling jacket is circulated such that it bypasses the radiator at the time the engine stops. This can reduce the water flow resistance in a path, so that a small motor-driven pump can be used.

The radiator is disposed such that an upper end portion of the radiator is positioned at a height corresponding to the lower end of the cylinder block. This can prevent the wind to be delivered to the cylinder block from being blocked by the radiator, thereby securing air-cooling performance.

The radiator is so disposed as to be surrounded by the seat provided above the radiator, and the vehicle components provided in the front of and in the rear of as well as on the left and right sides of the radiator. Therefore, the radiator can be placed in an inconspicuous location, in other words, in an unnoticeable location, improving the external appearance of the motorcycle.

DETAILED DESCRIPTION OF THE PREFERRED EMBODIMENTS

The embodiments of the present invention will be hereinafter described with reference to the appended drawings.

Figure 1:
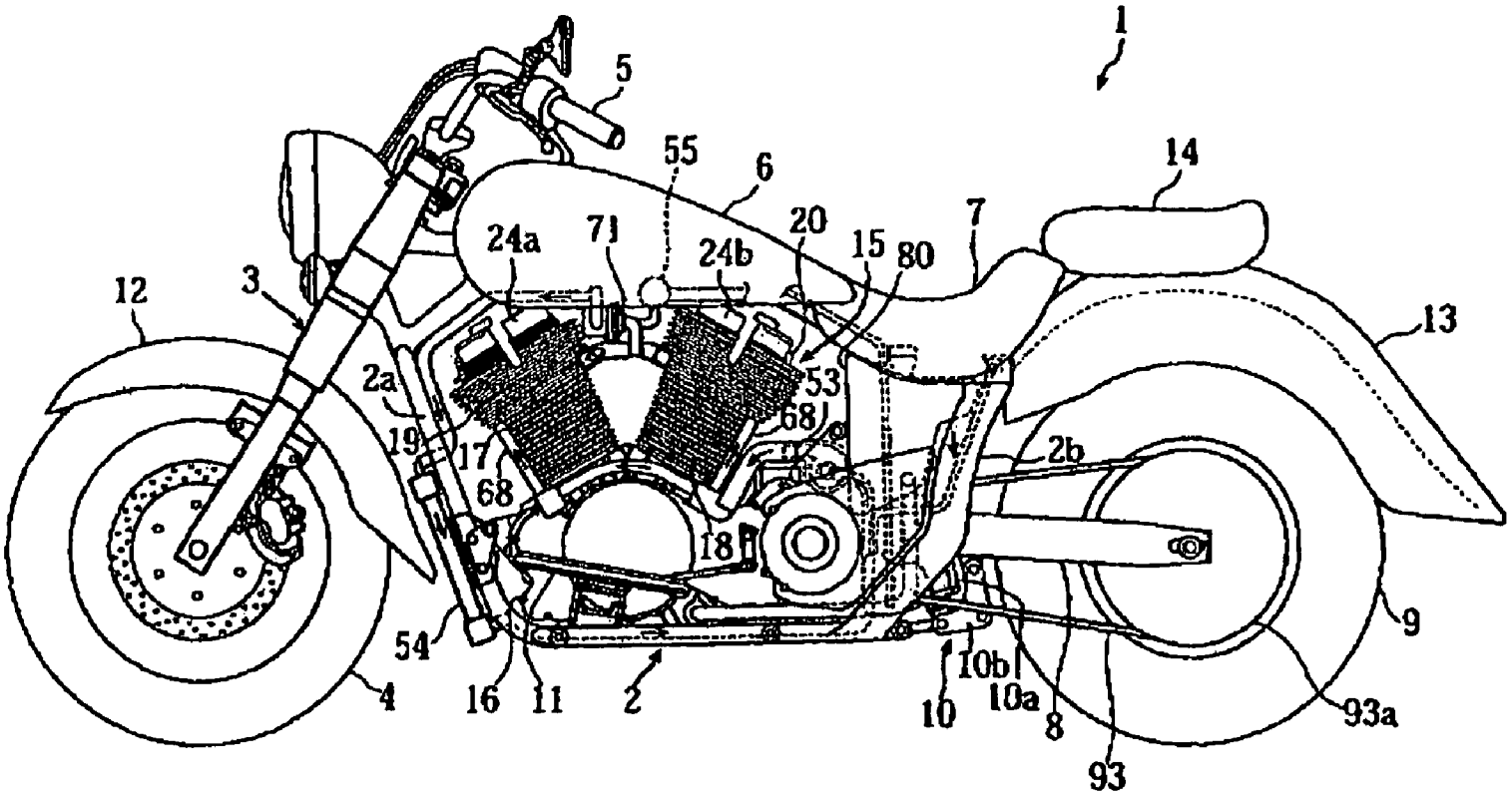
FIG. 1 is a left side view of a motorcycle carrying an engine according to an embodiment of the present invention.
Figure 2:
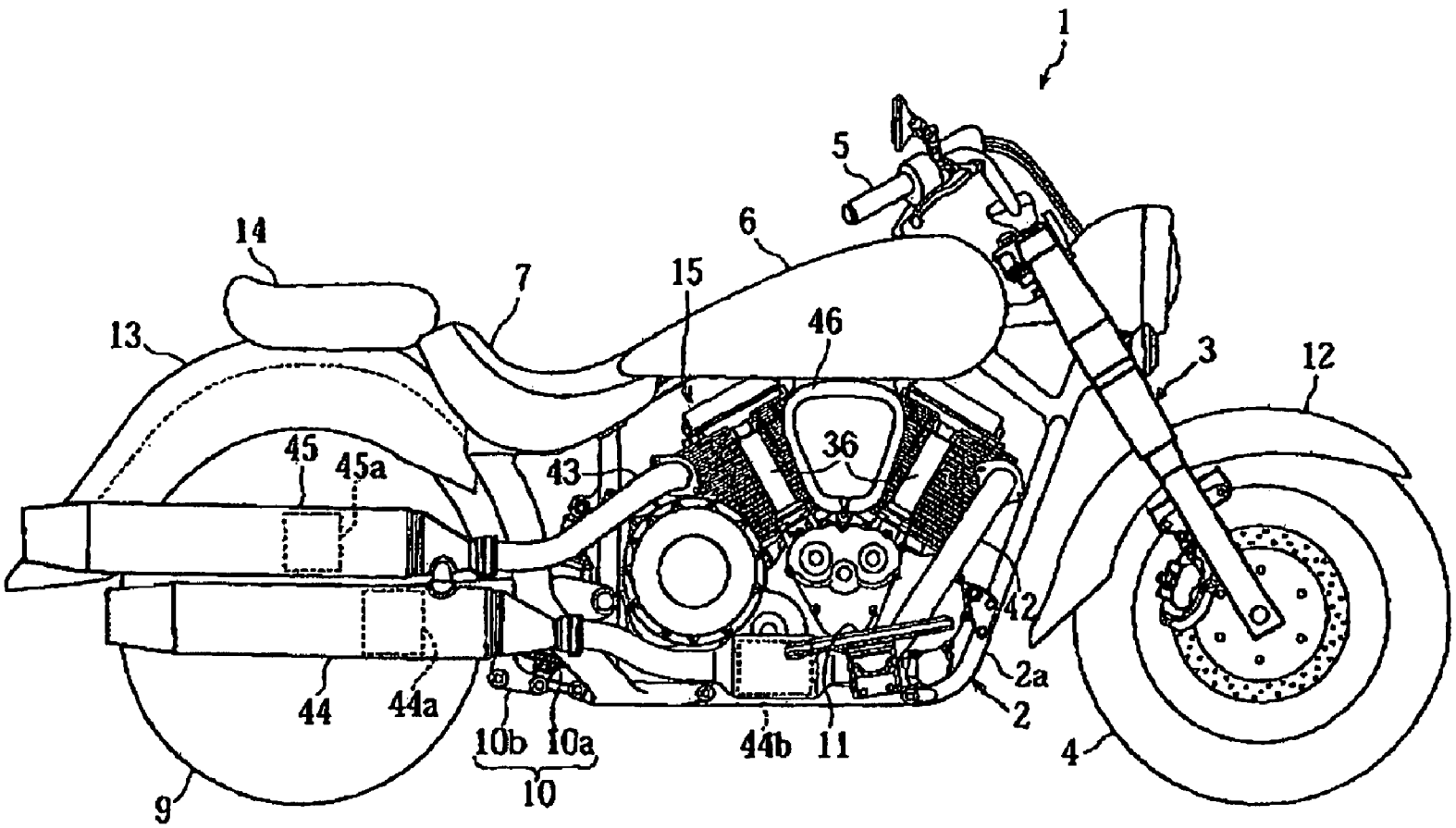
FIG. 2 is a right side view of the motorcycle.
Figure 3:
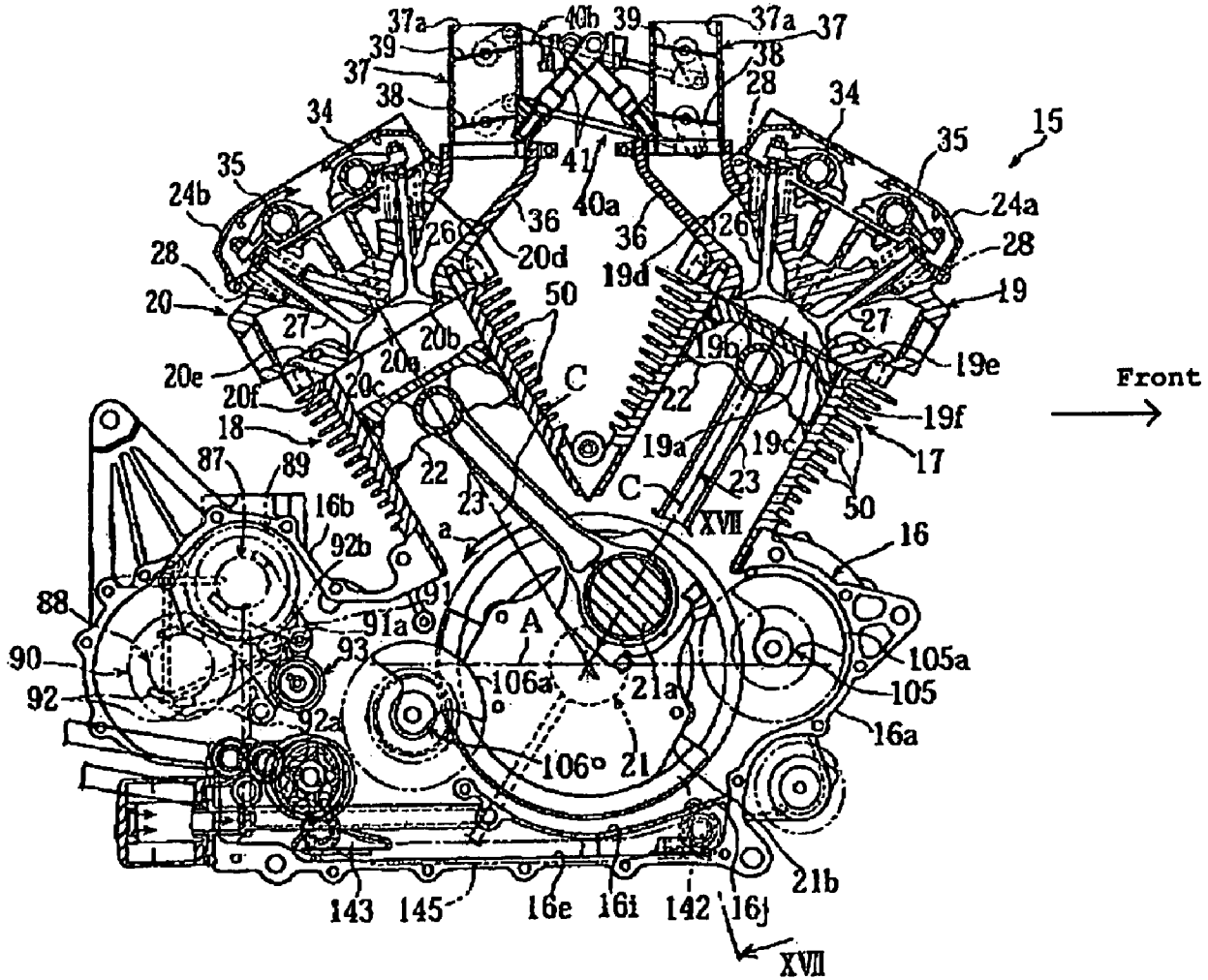
FIG. 3 is a sectional right side view of the engine.
Figure 4:
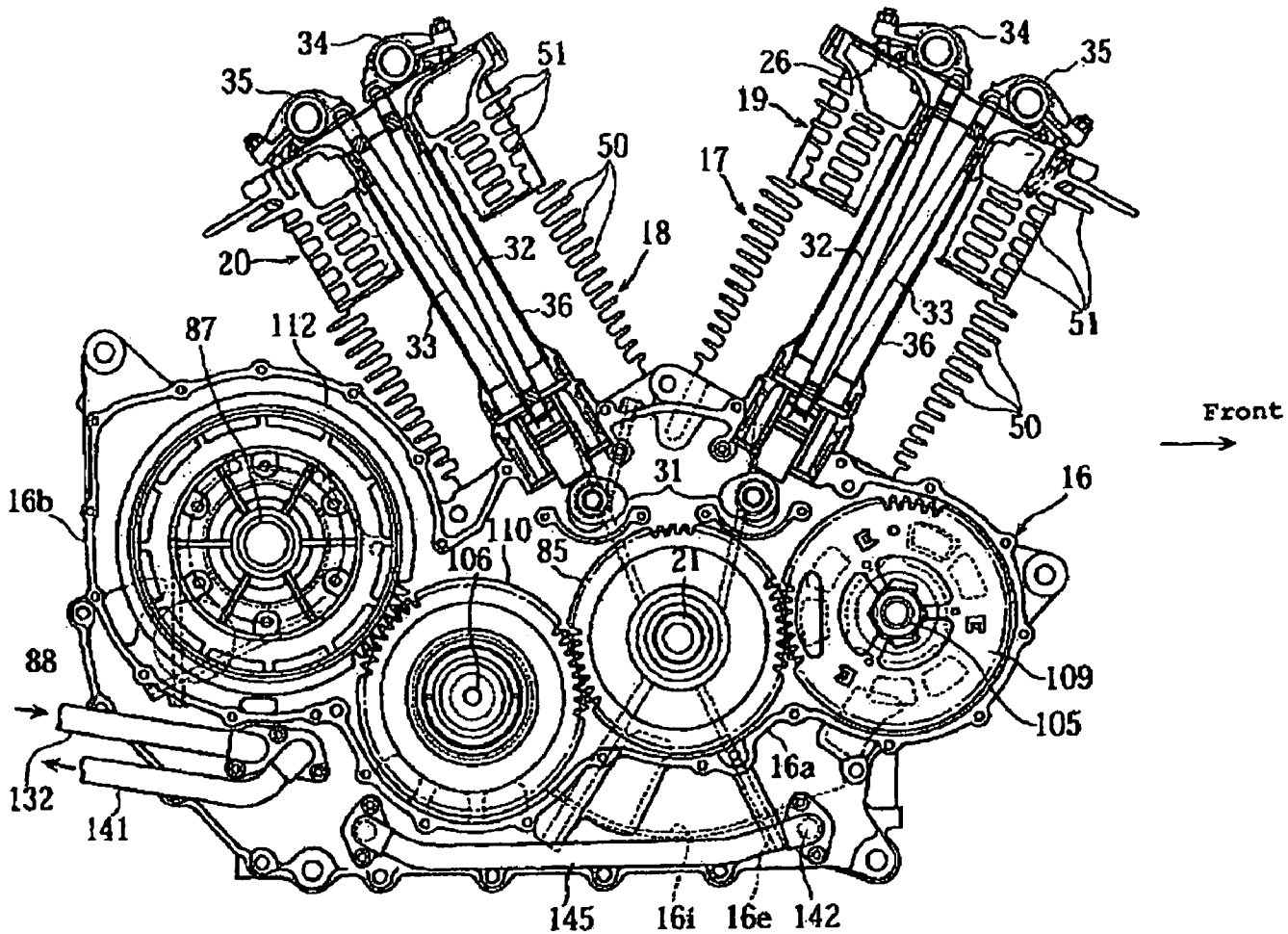
FIG. 4 is a sectional right side view of the engine.
Figure 5:
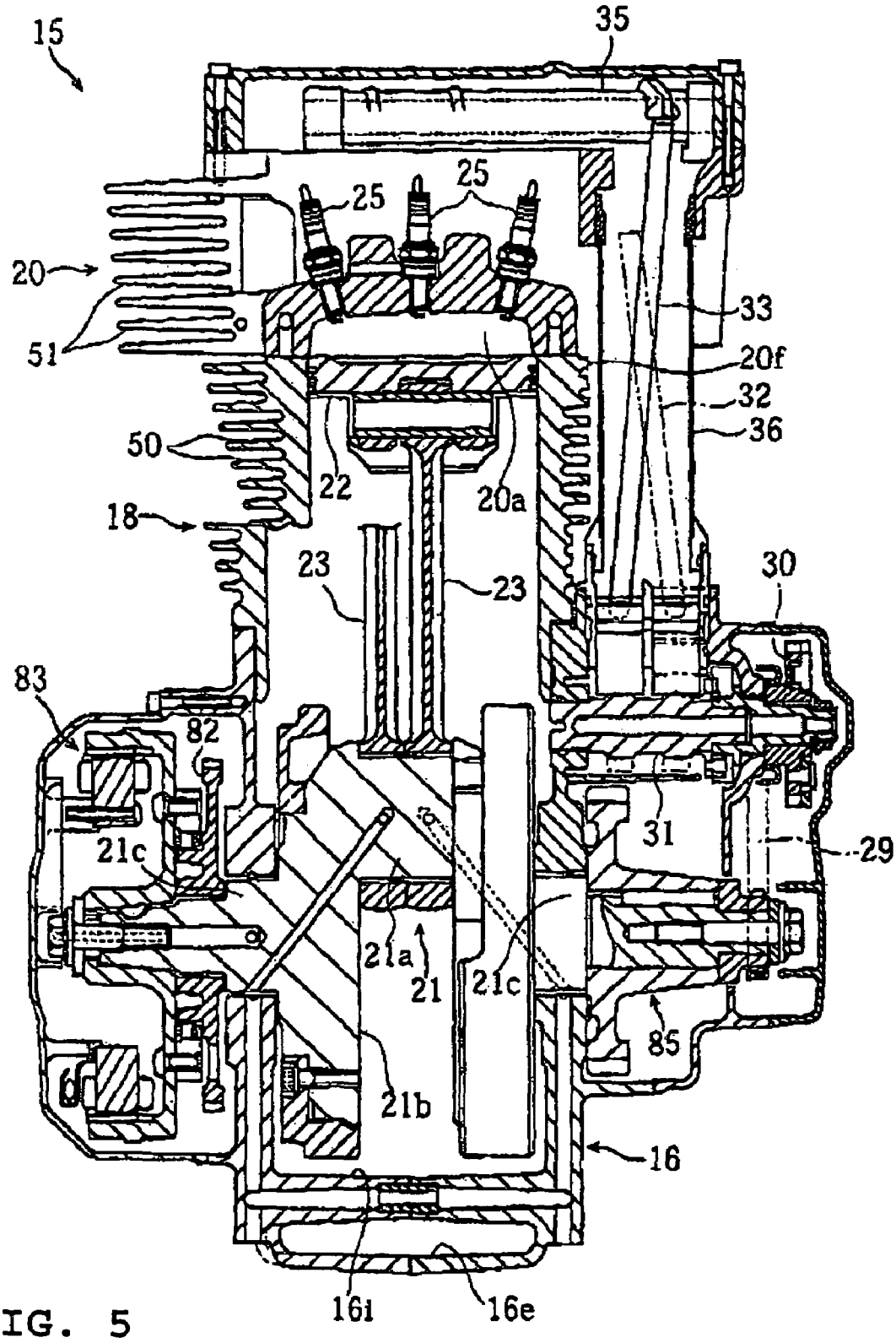
FIG. 5 is a sectional rear view of the engine.
Figure 6:
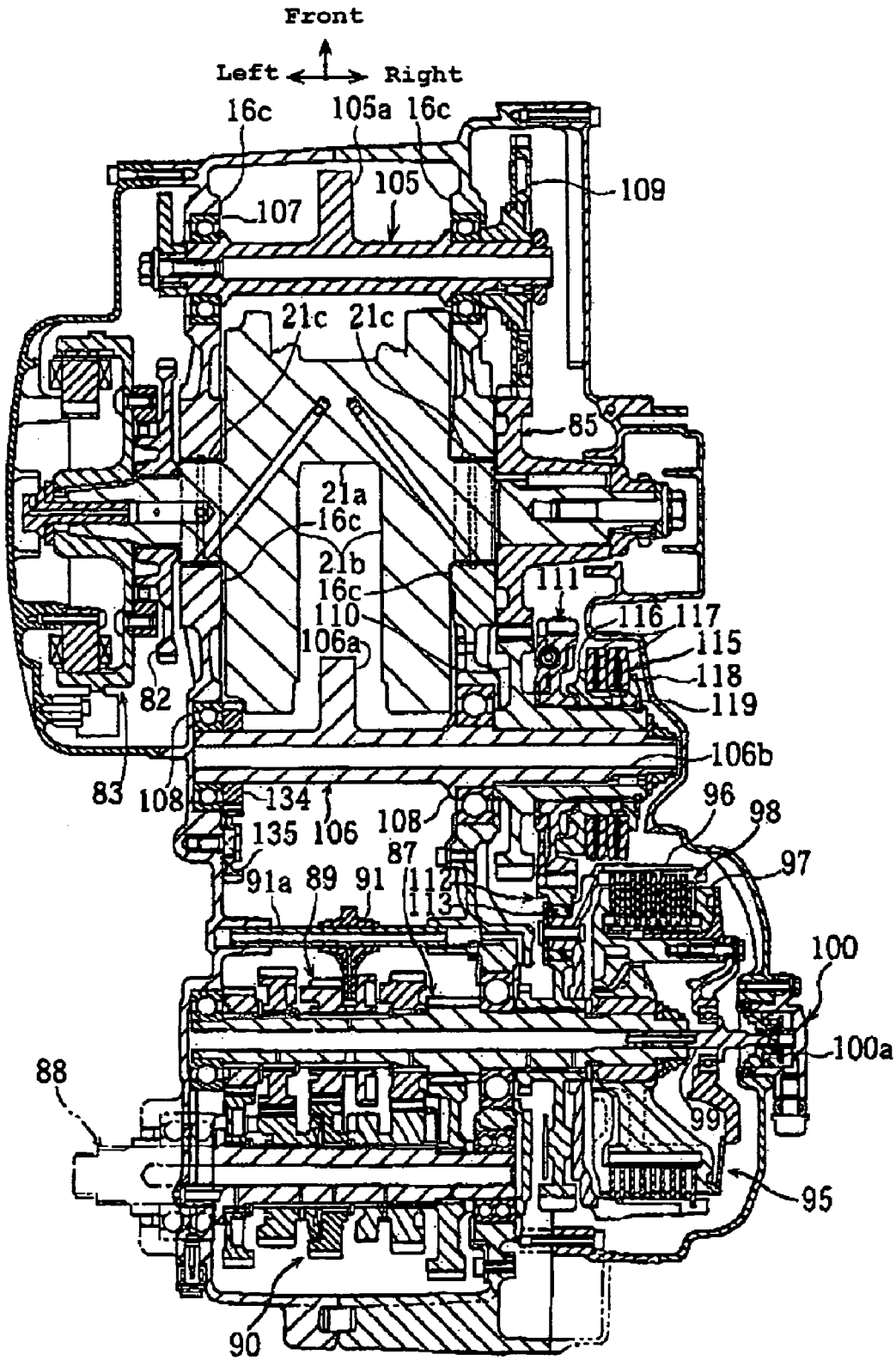
FIG. 6 is a sectional plan view of the engine.
Figure 7:
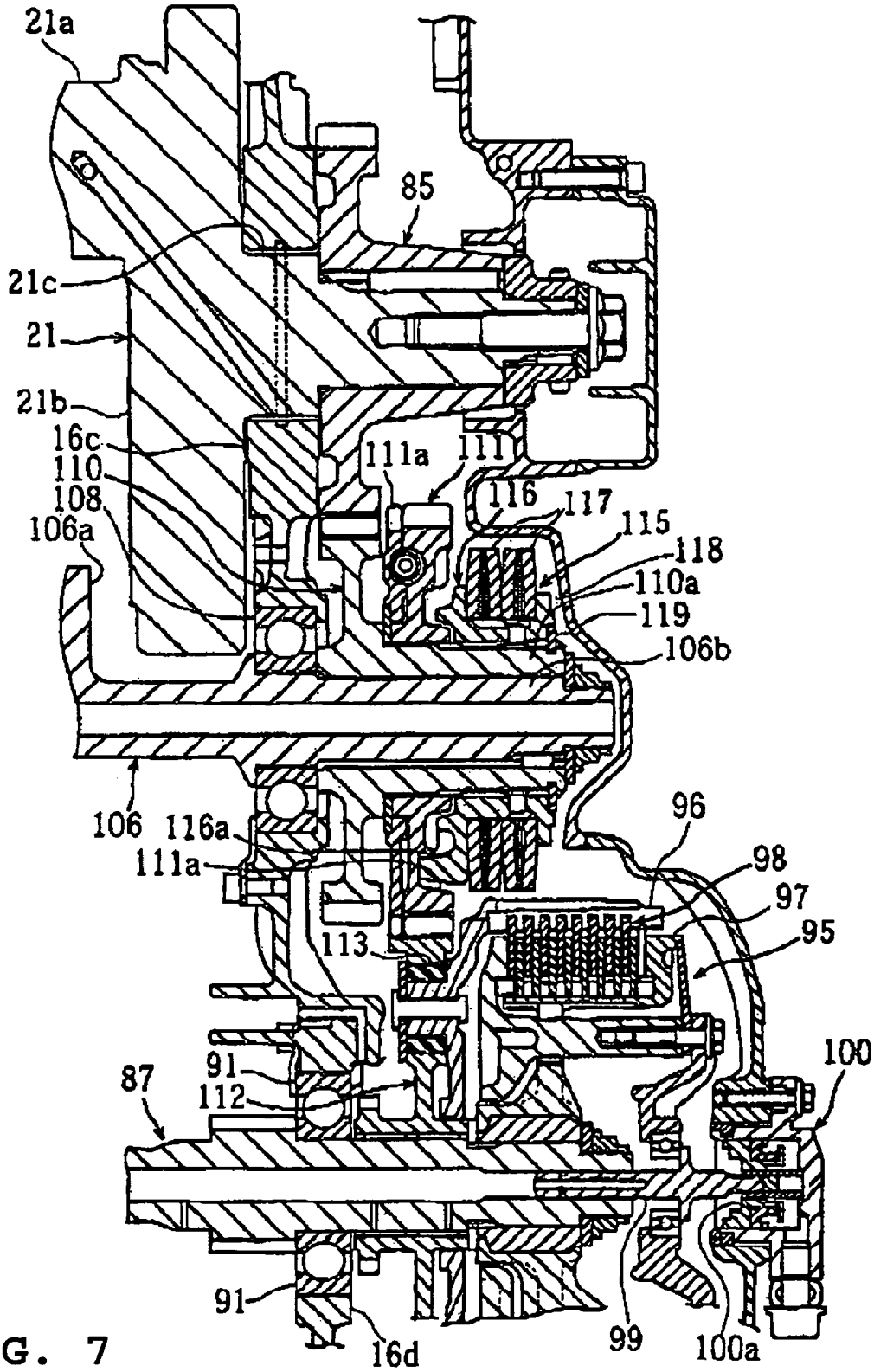
FIG. 7 is a sectional plan view of a power transmission path of the engine.
Figure 8:
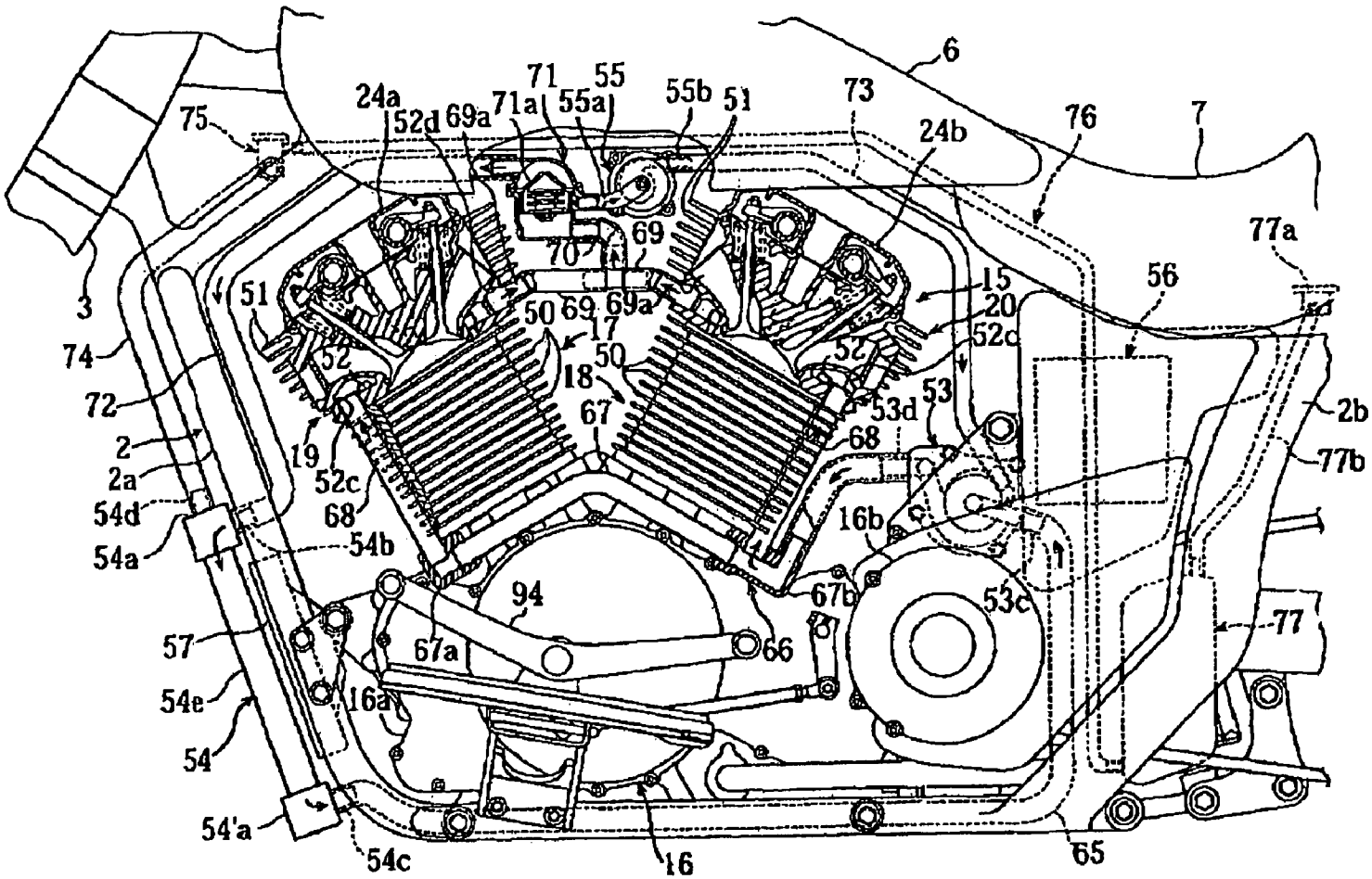
FIG. 8 is an overall view of a partial water cooling system of the engine.
Figure 9:
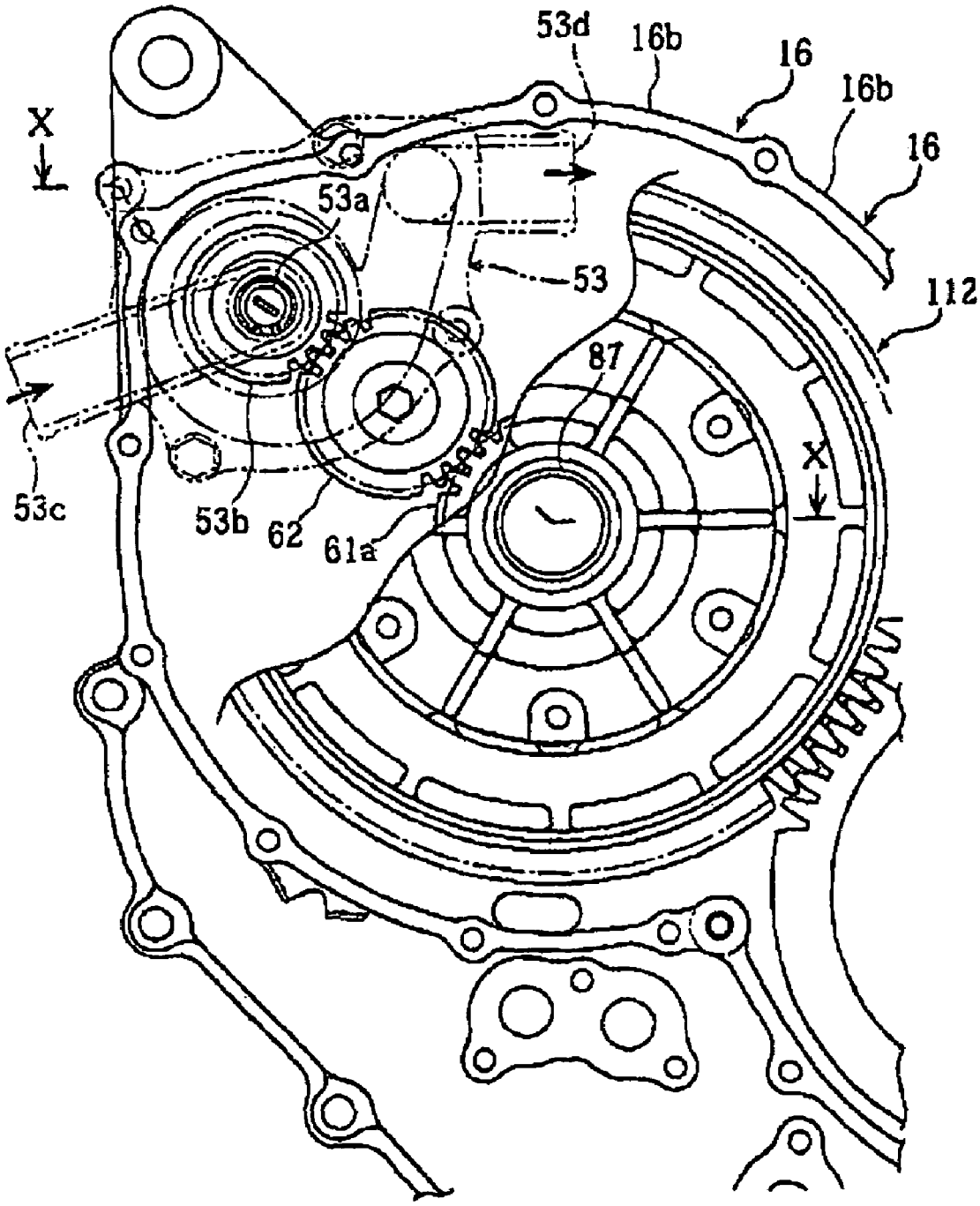
FIG. 9 is a sectional side view of a water pump section of the partial water cooling system.
Figure 10:
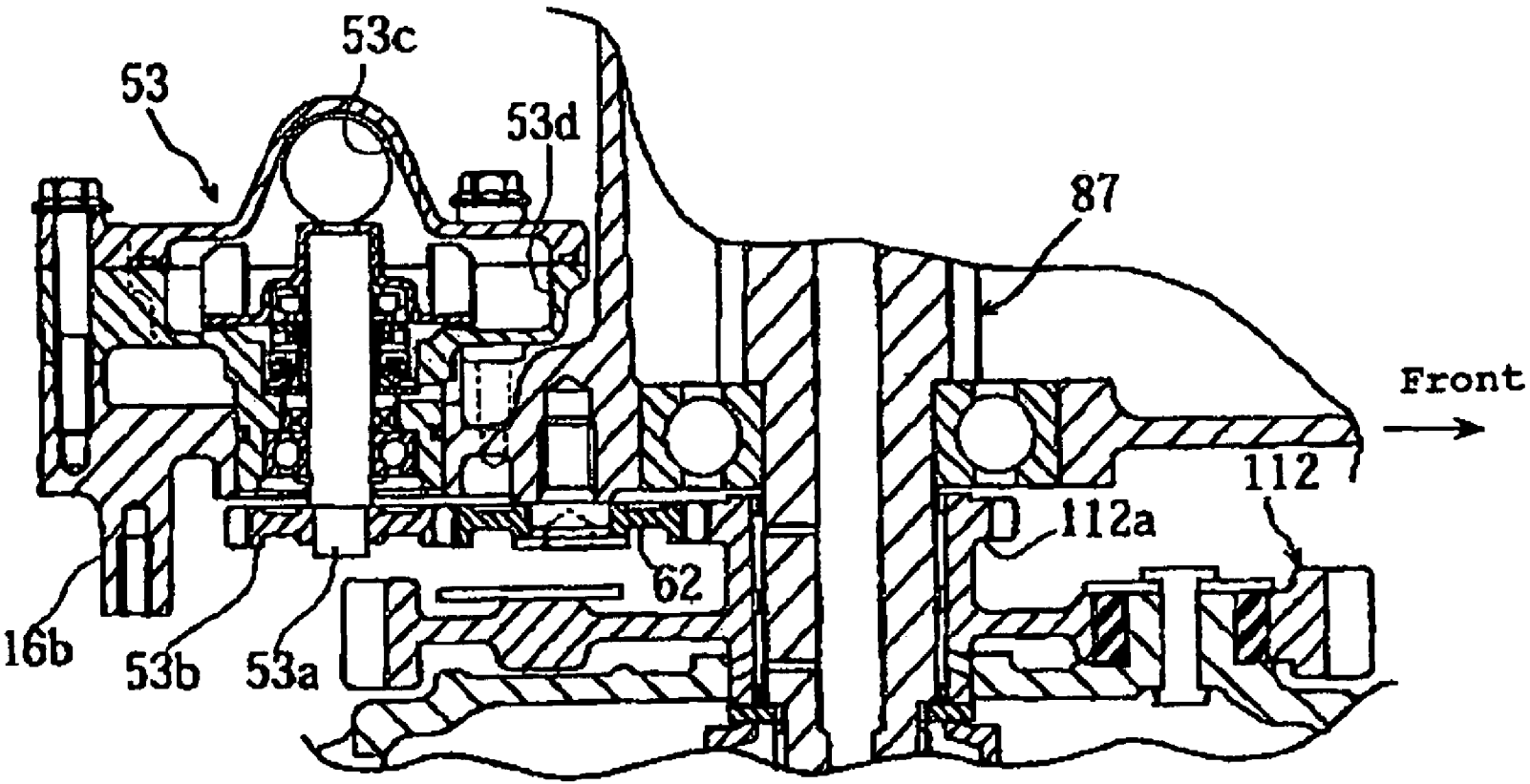
FIG. 10 is a sectional view taken along the line X-X of FIG. 9.
Figure 11:
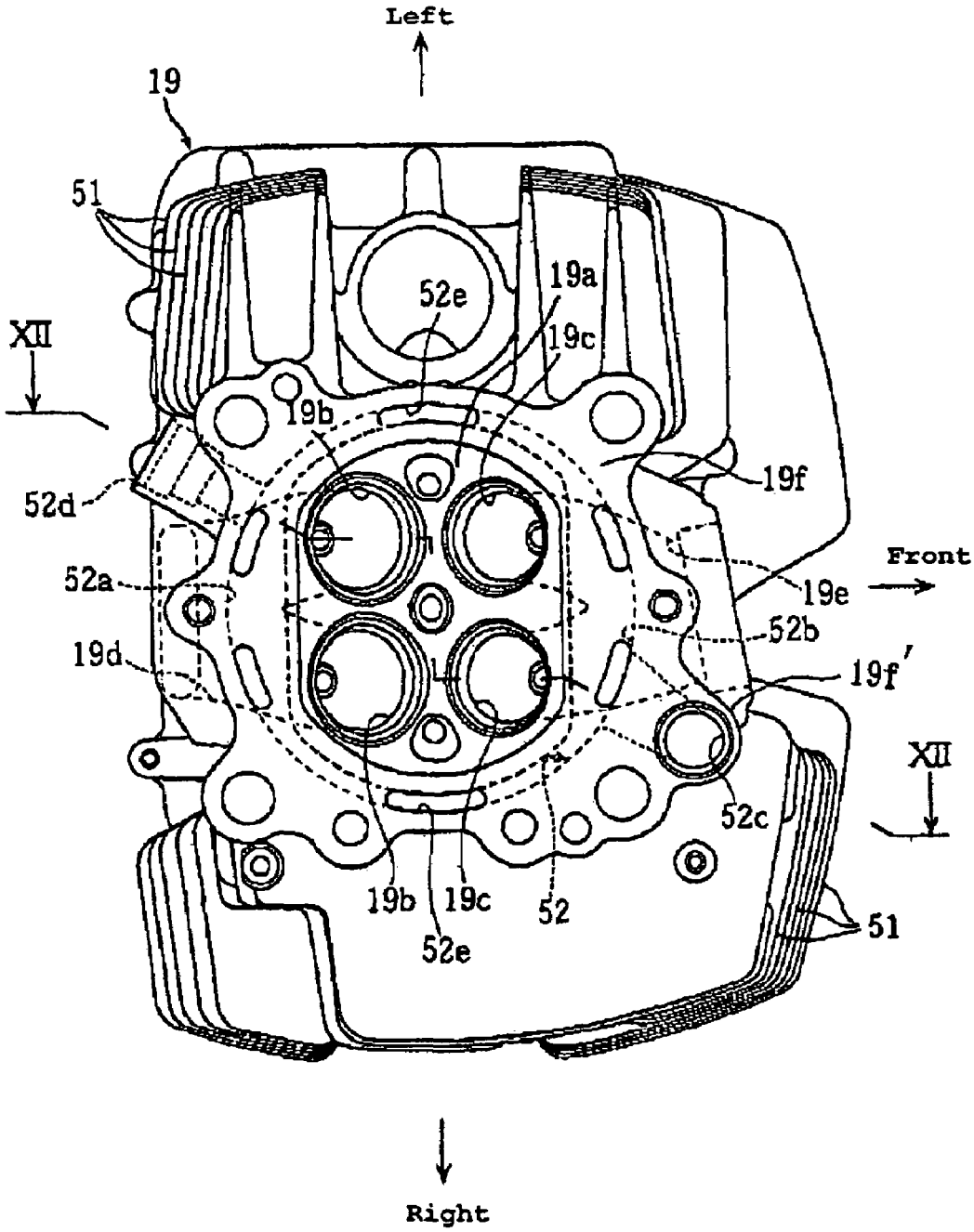
FIG. 11 is a bottom view of a cylinder head.
Figure 12:
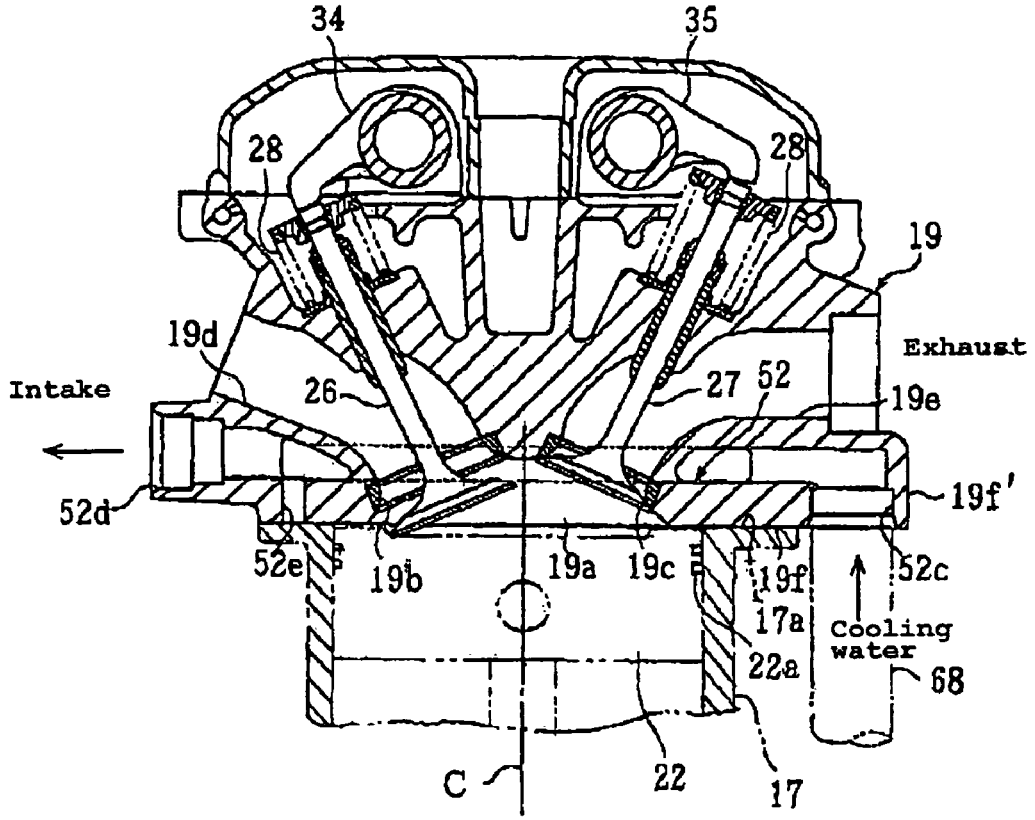
FIG. 12 is a sectional view taken along the line XII-XII of FIG. 11.
Figure 13:
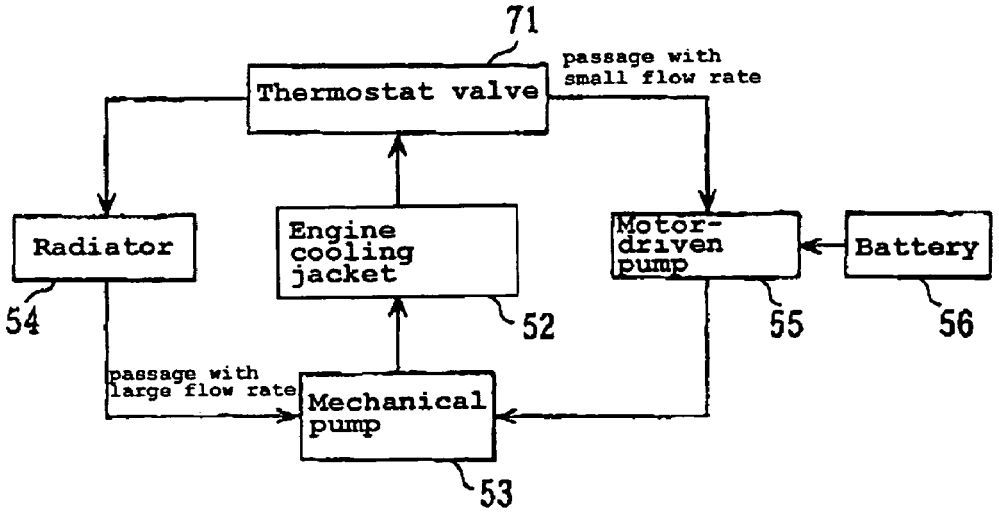
FIG. 13 is a block diagram of the partial water cooling system.
Figure 14:
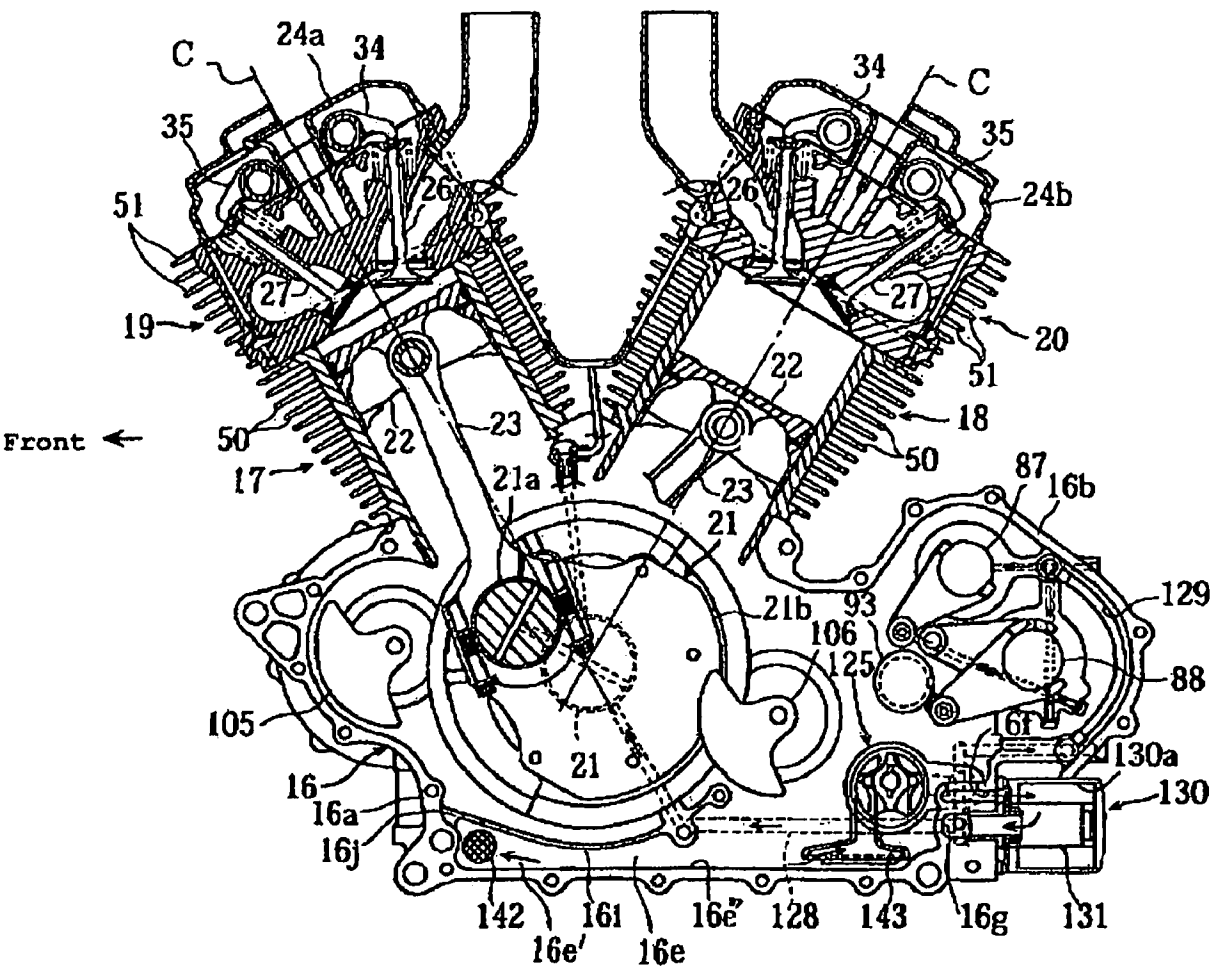
FIG. 14 is a sectional left side view showing a lubrication system of the engine.
Figure 15:
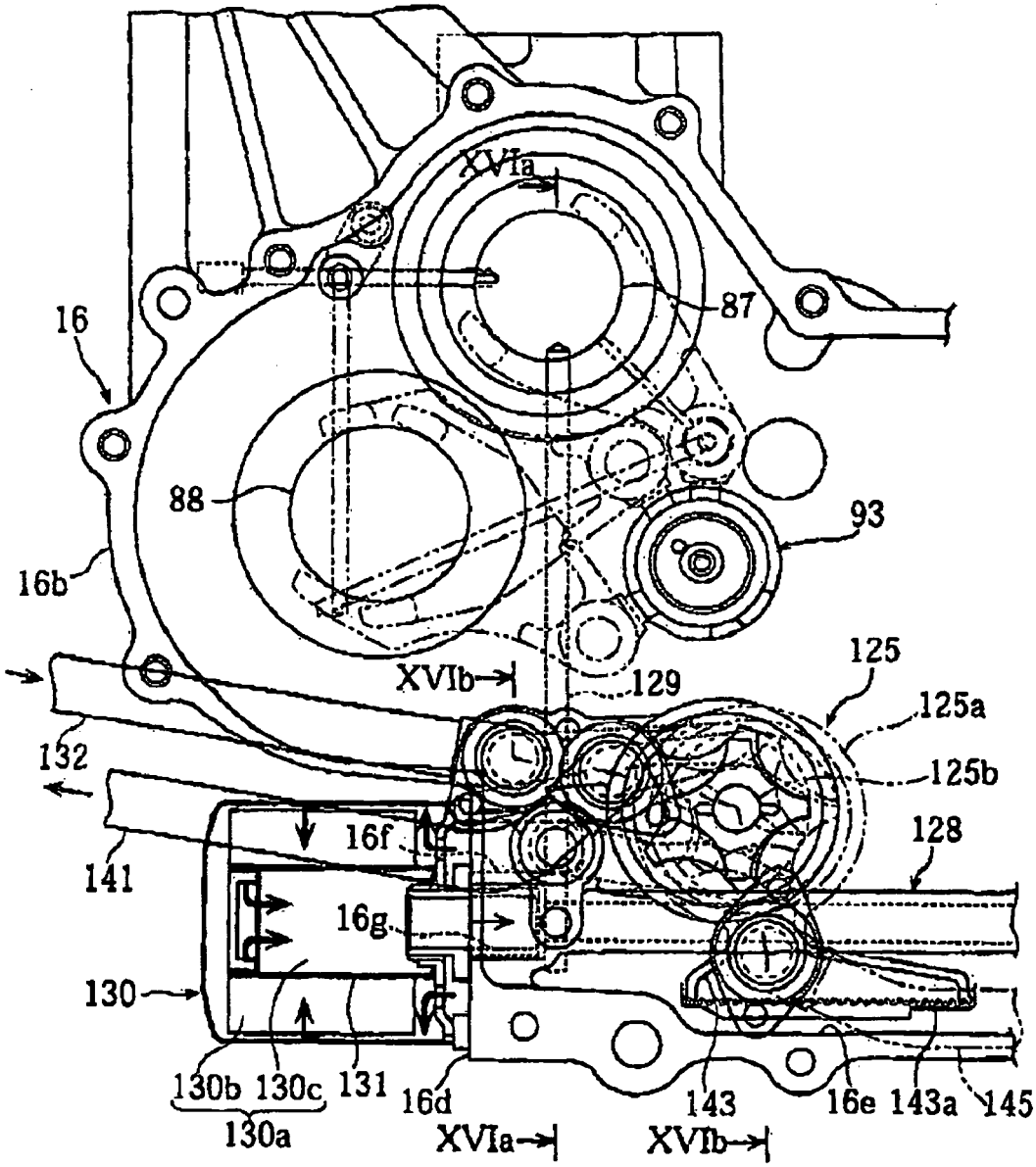
FIG. 15 is a right side view of an oil pump of the engine and its surrounding portion.
Figure 16:
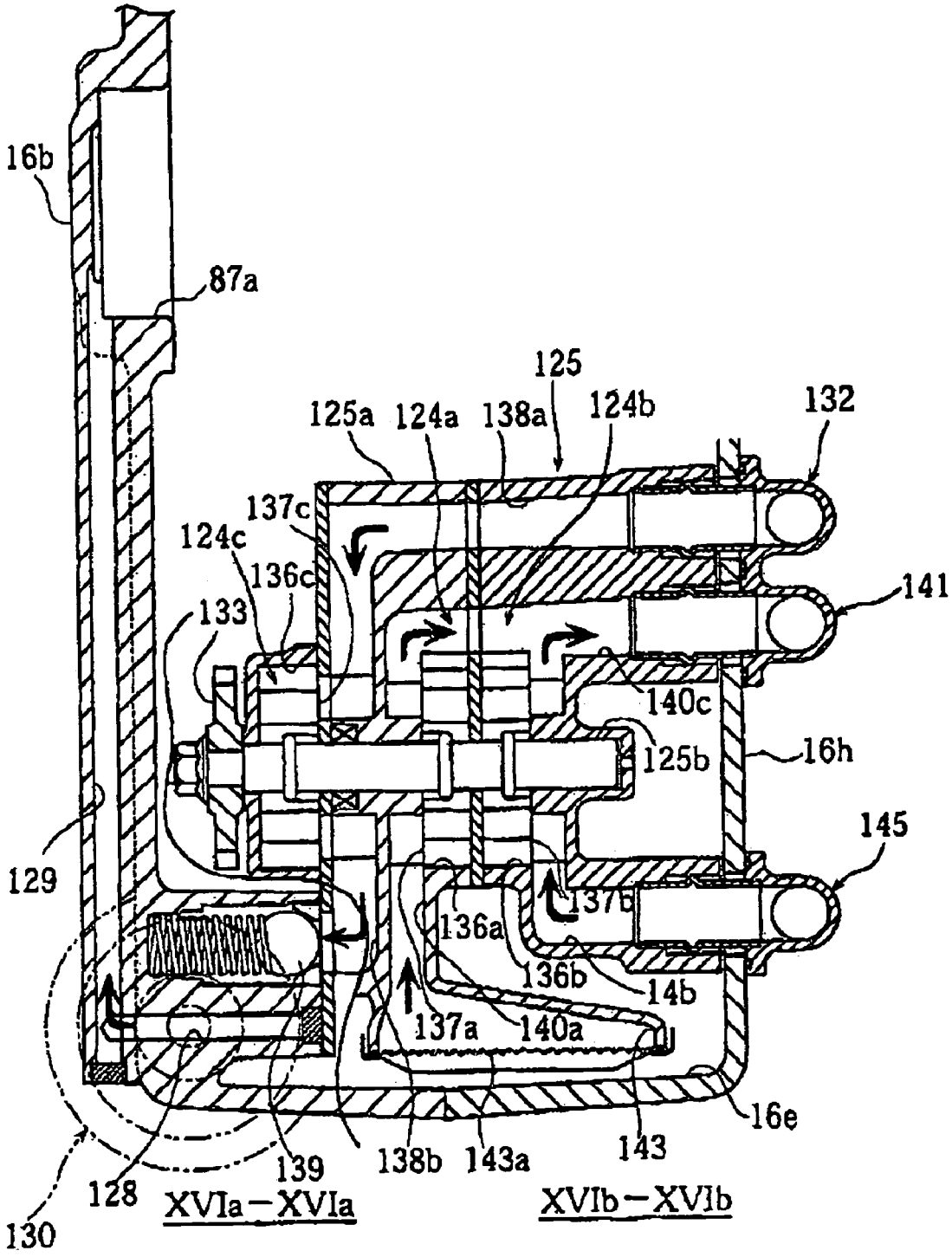
FIG. 16 is a sectional view taken along the line XVIa-XVIa and the line XVIb-XVIb of FIG. 15.
Figure 17:
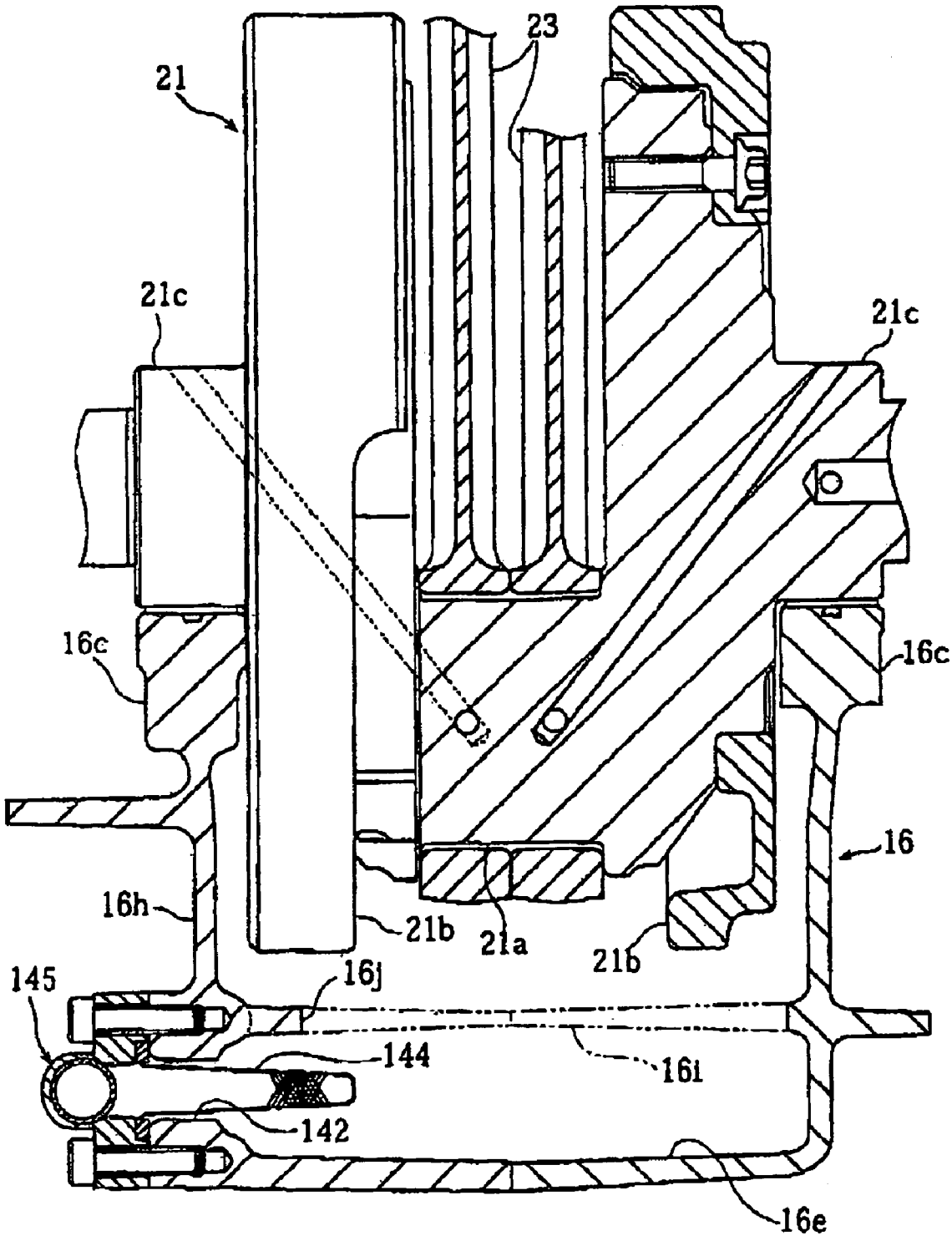
FIG. 17 is a sectional view of an oil sump of the crankcase of the engine (sectional view taken along the line XVII-XVII of FIG. 3).
Figure 18:
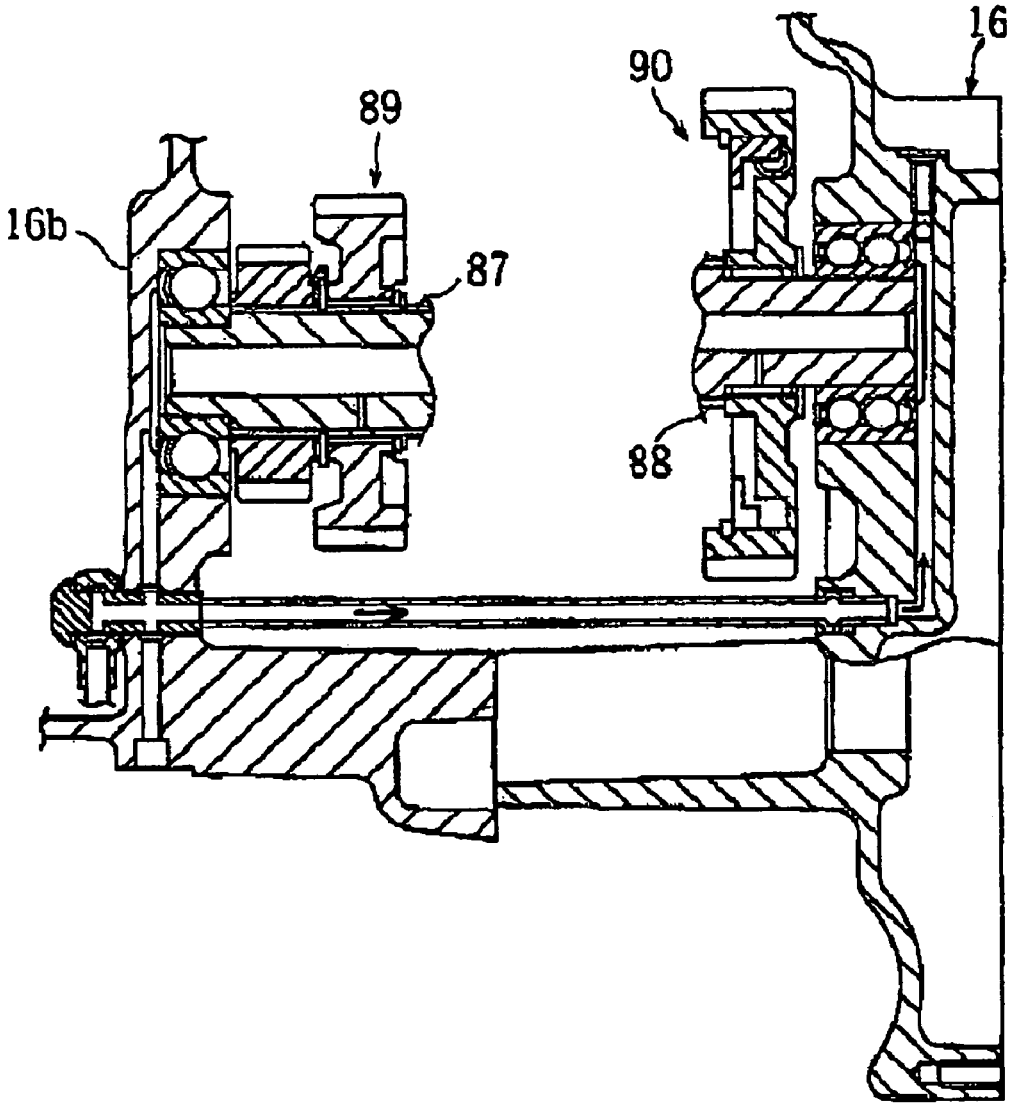
FIG. 18 is a sectional view of a lubrication path of a transmission of the engine.
Figure 19:
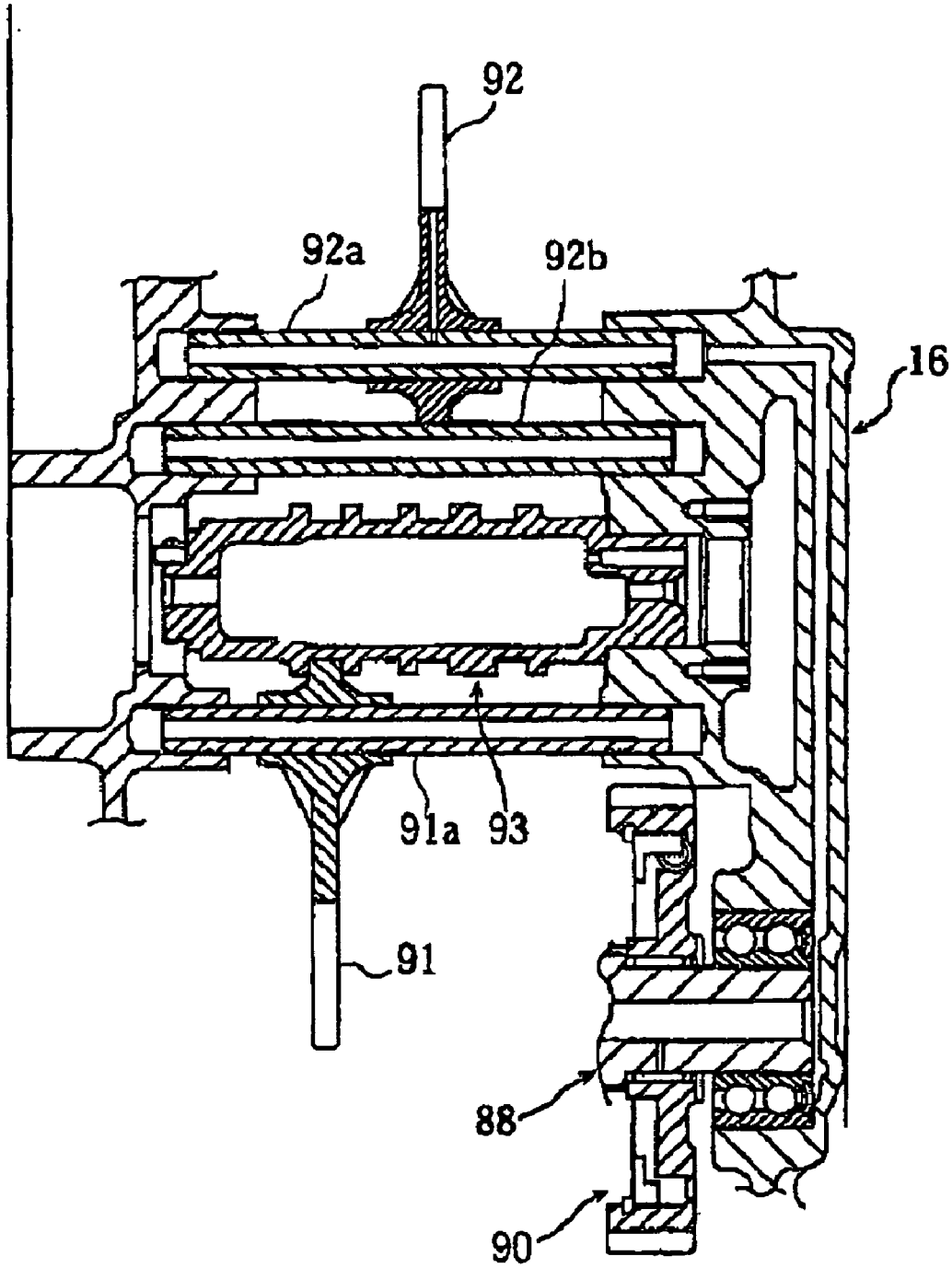
FIG. 19 is a sectional view of a lubrication path of the engine.
Figure 20:
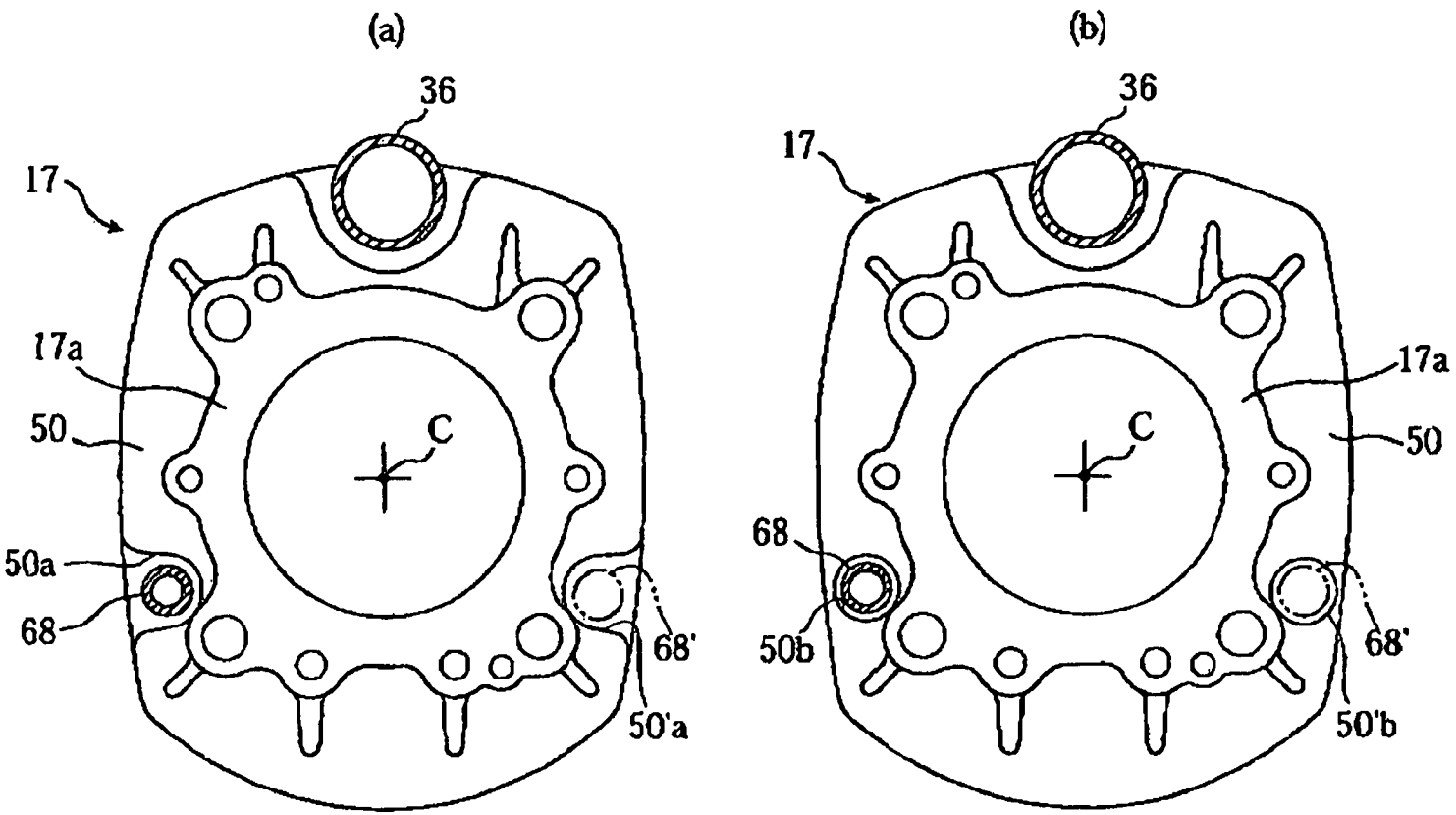
FIG. 20(*a*) and FIG. 20(*b*) are plan views of a cylinder block of the engine.
Figure 21:
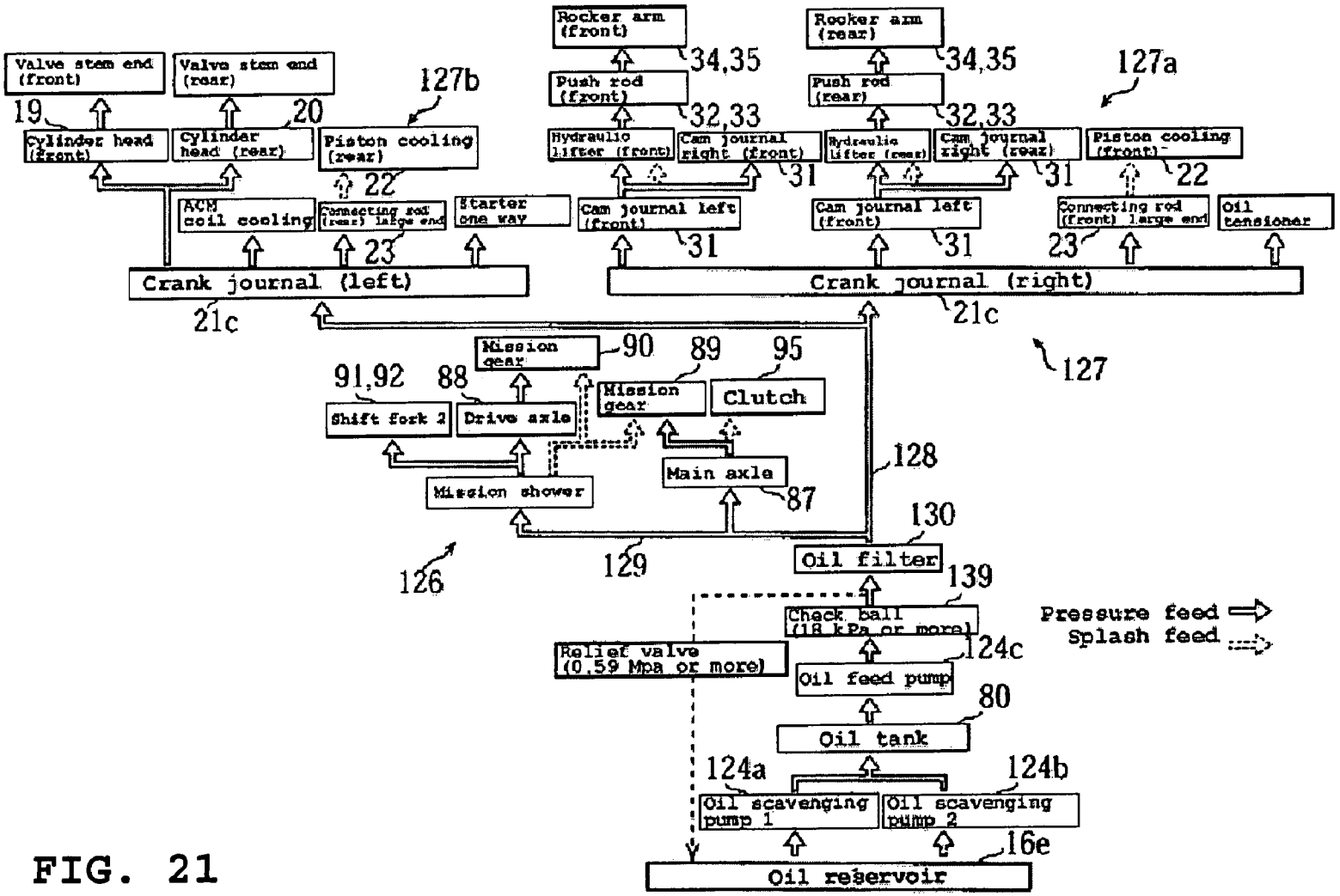
FIG. 21 is a system diagram of a lubricant path of the engine.

FIG. 1-FIG. 21 are views illustrating a four-stroke engine according to an embodiment of the present invention. FIG. 1 and FIG. 2 are left side and right side views of a motorcycle carrying an engine of this embodiment. FIG. 3 and FIG. 4 are sectional right side views of the engine. FIG. 5 is a sectional rear view of the engine. FIG. 6 is a sectional plan view of the engine. FIG. 7 is a sectional plan view of a power transmission section of the engine. FIG. 8 is an overall view of a partial water cooling system of the engine. FIG. 9 is a sectional side view of a water pump section of the partial water cooling system. FIG. 10 is a sectional view taken along the line X-X of FIG. 9. FIG. 11 is a bottom view of a cylinder head. FIG. 12 is a sectional view taken along the line XII-XII of FIG. 11. FIG. 13 is a block diagram of the partial water cooling system. FIG. 14 is a sectional left side view showing a lubrication system of the engine. FIG. 15 is a sectional side view of an oil pump section of the engine. FIG. 16 is a sectional view taken along the line XVIa-XVIa and line XVIb-XVIb of FIG. 15. FIG. 17 is a sectional view of an oil sump of the crankcase. FIG. 18 and FIG. 19 are sectional views of a transmission. FIG. 20(*a*)

and FIG. 20(*b*) are plan views of a cylinder block. FIG. 21 is a block diagram showing a lubricant path of the engine. Here, terms "front and rear" and "left and right" referred to in this embodiment means "front and rear" and "left and right" when viewed by a driver on the seat.

In these figures, reference numeral 1 designates a motorcycle of a cruiser type. In the motorcycle 1, a front fork 3 is supported by a head pipe (not shown) fixed at the front end of a body frame 2 of a double cradle type. A front wheel 4 is supported at the lower end of the front fork 3 and a steering handle 5 is disposed at the upper end. A fuel tank 6 and a seat 7 are disposed at the upper part of the body frame 2 and a rear wheel 9 is supported at the rear end of a rear arm 8 supported on a rear arm bracket 2*b* for an up and down swinging movement.

Between the rear arm 8 and the body frame 2 is disposed a rear suspension 10 made up of a shock absorber 10*a* and a link mechanism 10*b*. Foot rest boards 11 for supporting a driver's feet are disposed at the sides of left and right down tubes 2*a* of the body frame 2.

A front fender 12 for covering the upper part of the front wheel 4 is attached to the front fork 3. A rear fender 13 for covering approximately the upper half of the rear wheel 9 is attached to a rear frame (not shown) extending rearward from the upper end of the rear arm bracket 2*b* and a rear seat 14 is disposed on the upper side of the rear fender 13.

In a cradle of the body frame 2, an engine 15 is mounted with its crankshaft oriented in the lateral direction. The engine 15 is an air-cooled, four-stroke, OHV and V-type, two-cylinder engine. A front cylinder block 17 and a rear cylinder block 18 are disposed on the upper surface of a crankcase 16, making a given angle to each other in the longitudinal direction. A front cylinder head 19 and a rear cylinder head 20 are piled on the upper mating surfaces of the front and rear cylinder blocks 17, 18, respectively, for the connection with head bolts. In addition, head covers 24*a*, 24*b* are mounted on the upper mating surfaces of the cylinder heads 19, 20.

The crankcase 16 has a construction in which a crankcase section 16*a* containing a crankshaft 21, and a mission case section 16*b* containing a transmission mechanism (described later) are formed integrally. The crankshaft 21 is disposed horizontally in the lateral direction, the rotational direction of which is set to be counter-clockwise as seen from the right side (see arrow [a] in FIG. 3). The crankshaft 21 has a crank pin 21*a* common to the front and rear cylinders, left and right crank arms 21*b* as well as crank journals 21*c*.

The front and rear cylinder blocks 17, 18 have cylinder bores (cylinders) of diameter over 100 mm, respectively. Pistons 22 are each inserted in the respective cylinder bores for sliding movement and the pistons 22 are connected to a crank pin 21*a* of the crankshaft 21 common to the front and rear cylinders, through connecting rods 23.

In the lower mating surfaces (mating surfaces on the cylinder block side) 19*f*, 20*f* of the front and rear cylinder heads 19, 20, recesses of combustion chambers 19*a*, 20*a* are formed, facing the cylinder bores.

The combustion chamber generally includes a recess formed on the mating surface of the cylinder head, a top surface of the piston, and an inner circumference of the cylinder bore at its upper end. However, in this embodiment, the recess of the cylinder is simply referred as a combustion chamber.

As shown in FIG. 11, the combustion chambers 19*a*, 20*a* are formed into an ellipse or oval shape having a long axis extending in the crankshaft direction (vertical direction in FIG. 11) viewed in a cylinder axis direction C. Also, three spark plugs 25 are located at an interval in the crankshaft direction (lateral direction of a vehicle). The combustion chambers 19*a*, 20*a* are formed with two intake valve openings 19*b* and 20*b* and two exhaust valve openings 19*c* and 20*c*, respectively.

Intake valves 26 and exhaust valves 27 are disposed in the intake valve openings 19*b*, 20*b* and in the exhaust valve openings 19*c*, 20*c*, respectively, such that they are adapted to be opened and closed, and biased towards a valve closing by coil springs 28. Regarding the intake valve 26 and the exhaust valve 27, as shown in FIG. 4 and FIG. 5, the intake side and the exhaust side push rods 32, 33 are advanced upwardly and retracted downwardly through front and rear cam shafts 31 rotated by the crankshaft 21, and the push rods 32, 33 cause the intake side and the exhaust side rocker arms 34, 35 to rock, whereby they are driven to be opened/closed. The cam shafts 31 are provided, parallel to the crankshaft 21, in the crankcase 16 and rotated by the crankshaft 21 through a chain 29, a middle shaft (not shown) and a timing gear 30.

The intake side and exhaust side push rods 32, 33 are contained in cylindrical casings 36 provided along the cylinder axes of the front and rear cylinder blocks 17, 18 and exposed to the right side.

The intake valve openings 19*b*, 20*b* of the front and rear cylinder heads 19, 20 are led out to the inside wall of the V-bank through each joined flow intake port 19*d*, 20*d*. To the front and rear intake ports 19*d*, 20*d* are connected throttle bodies 37 through front and rear intake pipes 36 with their axes oriented approximately vertically, and to an air inlet 37*a* of each throttle body 37 is connected a common air cleaner 46.

A main throttle valve 38 is provided on the downstream side of the throttle body 37 and a sub-throttle valve 39 on the upstream side. Valve shafts of the front and rear main throttle valves 38 are connected to each other and those of the sub-throttle valves 39 are connected to each other through link mechanisms 40*a*, 40*b*, respectively.

Fuel injection valves 41 are mounted to the front and rear throttle bodies 37 on the downstream side from the throttle valves 38, respectively, and the injection head of the fuel injection valve 41 is disposed such that fuel is injected towards the back of the intake valve 26.

The exhaust valve openings 19*c*, 20*c* of the front and rear cylinder heads 19, 20 are led out to the outside wall of the V-bank through each joined flow intake port 19*e*, 20*e*. To the front and rear exhaust ports 19*e*, 20*e* are connected front and rear exhaust pipes 42, 43, as shown in FIG. 2. The exhaust pipes 42, 43 extend rearward on the right side of the body and to the downstream ends of the exhaust pipes are connected front and rear mufflers 44, 45 provided at the right side of the rear wheel 9.

Catalysts 44*a*, 45*a* for purifying exhaust gas are provided in the front and rear mufflers 44, 45, respectively. An auxiliary catalyst 44*b* is provided in the middle of the front exhaust pipe 42. Since the front exhaust pipe 42 has the length larger than that of the rear exhaust pipe 43, activation of the catalyst 44*a* is apt to be delayed during warming up of the engine. Therefore, the auxiliary catalyst 44*b* is provided in the front exhaust pipe 42 to accelerate exhaust gas purification during warming up of the engine.

Now, the cooling structure of the air-cooled engine 15 will be described with reference mainly to FIG. 8-FIG. 13.

Numerous cooling fins 50, 51 are formed integrally on the outside walls of the front and rear cylinder blocks 17, 18 and front and rear cylinder heads 19, 20, at approximately right angles to the cylinder axis C. The running wind blows directly on the cylinder blocks 17, 18 and cylinder heads 19, 20, so that heat from the engine is released through the cooling fins 50, 51 for the cooling of the engine 15.

The air-cooled engine 15 of this embodiment, while mainly utilizing air-cooling by the wind, is provided with a partial water cooling system operated with cooling water, the construction of which is described below. The same cooling structures are used both in the front side and the rear side cylinder, and description will be made mainly for the front side cylinder.

In this embodiment, a cooling jacket 52 is formed only in a portion of the front cylinder head 19 between a virtual object of approximately an inverted, truncated conical shape generated by the intake port 19*d* or exhaust port 19*e* being rotated about the cylinder axis C, and the lower mating surface (mating surface on the cylinder block side) 19*f* of the cylinder head 19.

More specifically, the front cylinder head 19 is formed with the annular cooling jacket 52, of about 60 cc in volume, surrounding the peripheral portion of the recess of the combustion chamber 19*a* on the lower mating face of the cylinder head 19 and passing through the cylinder head 19 between the intake and exhaust ports 19*d*, 19*e* and the lower mating surface 19*f*. As shown in FIG. 11, a portion 52*a* of the cooling jacket 52 between intake valves corresponding in position to the region reward of the intake valve openings 19*b* and a portion 52*b* between exhaust valves corresponding in position to the region forward of the exhaust valve openings 19*c* have larger passage areas than the other. More specifically, the portion 52*a* between the intake valves and the portion 52*b* between the exhaust valves pass through the lower side of the jointed flow intake port 19*d* and the jointed flow exhaust port 19*e*, respectively, in a direction of the long axis of the approximately ellipse shape of the combustion chamber 19*a* viewed in the cylinder axis direction. As described above, the combustion chamber 19*a* is formed into an ellipse shape viewed in the cylinder axis direction, and the portion 52*b* between the exhaust valves passes in the direction of the long axis of the ellipse. Therefore, a larger area of the cooling jacket is secured on the lower side of the jointed flow exhaust port 19*e* with highest heat.

In the lower mating surface 19*f* of the front cylinder head 19 at the exhaust port 19*e* side is formed an overhang portion 19*f'* overhanging outward from the mating surface 17*a* of the cylinder block 17 in a radial direction of the cylinder (cylinder bore). In the overhang portion 19*f'*, a cooling water supply port (water port) 52*c* is formed therethrough for communication with the portion 52*b* between the exhaust valves of the cooling jacket 52. Also, a cooling water discharge port 52*d* in communication with the cooling jacket 52 is open at the inside wall of the V-bank of the front cylinder head 19 below the intake port 19*d*. The cooling water discharge port 52*d* is located higher than the cooling water supply port 52*c* (see FIG. 8), which prevents generation of air pockets in the cooling jacket 52. Reference numeral 52*e* designates a hole used for removing core sand when the cooling jacket 52 is casted, which is closed by a gasket placed between the cylinder block and cylinder head.

As described above, cooling water supplied from the cooling water supply port 52*c* first cools the region around the jointed flow exhaust port 19*e* at the highest temperature and flows towards the jointed flow intake port 19*d* to be discharged from the cooling water discharge port 52*d*.

The partial water cooling system is provided with a mechanical pump 53 driven for rotation by the crankshaft 21, a radiator 54 for cooling the cooling water supplied to the cooling jacket 52 with running wind, and a motor-driven pump 55 for circulating the cooling water in the cooling jacket 52 for a given time such that the cooling water bypasses the radiator 54 when stoppage of the engine 15 causes the mechanical pump 53 to stop.

The radiator 54 is provided in front of and at the lower ends of the vertical portions of the left and right down tubes 2*a* of the body frame 2, and a cooling fan 57 is disposed behind the radiator 54 such that it is located between the left and right vertical portions. The radiator 54 includes upper and lower headers 54*a*, 54*a'* connected by an element 54*e* having radiating fins; a cooling water inlet 54*b* formed in the back of the upper header 54*a*, a cooling water outlet 54*c* in the back of the lower header 54*a'* and a cooling water filler port 54*d* formed at the top of the upper header 54*a*. The radiator 54 is disposed such that the upper header (upper end portion) 54*a* is positioned at approximately the same height as the lower end of the front cylinder block 17 when viewed from the front of the vehicle.

The mechanical pump 53 is disposed upward of a main shaft 87 (described later) provided in the mission case section 16*b*, with the pump shaft 53*a* oriented in the direction parallel to the main shaft 87. A pump gear 53*b* fixed to the pump shaft 53*a* is meshed, through a middle gear 62, with a drive gear 112*a* formed integral with a large reduction gear 112 mounted on the main shaft 87 for relative rotation. This allows the mechanical pump 53 to be driven for rotation at all times by the crankshaft 21 during engine operation.

The cooling water outlet 54*c* of the radiator 54 is connected to a cooling water suction port 53*c* of the mechanical pump 53 by a cooling hose 65. The cooling hose 65 is laid along the horizontal portion of the down tube 2*a* at the inner side.

A supply pipe 66 is connected to a delivery port 53*d* of the mechanical pump 53. The supply pipe 66 includes a main supply pipe 67 in the shape of the letter C laid along the upper wall of the crankcase 16 opposite side (left side) to the side on which the push rods 32, 33 are disposed, and front and rear branch pipes (water pipes) 68 connected to the base and the leading end of the main supply pipe 67 through joints 67*a*, 67*b* and rising along the cylinder axes of the front and rear cylinder blocks 17, 18. The upper ends of the branch pipes 68 are connected to the cooling water supply ports 52*c* of the front and rear cylinder heads 19, 20, respectively.

The front and rear branch pipes (water pipes) 68 are disposed close to the cylinder axis C such that parts of the pipes are positioned within the cooling fins 50 formed on the cylinder blocks 17, 18. More specifically, as shown in FIG. 20(*a*), the branch pipes 68 are disposed such that parts of the pipes are positioned in recesses 50*a* formed on the cooling fins 50 by cutting out their portions on the exhaust side. This is designed for cooling the branch pipes 68 by the wind.

The upper cooling fins 50 (positioned closer to the cylinder head) are formed with a larger radius to have a larger heat radiation area. Therefore, the upper recesses 50*a* become larger towards the cylinder axis. As a result, the branch pipe 68 is disposed such that the upper part is completely buried in the cooling fins 50 while the lower part is more exposed to the outside.

In order to position the branch pipe 68 within the cooling fins 50, a structure, in which through holes 50*b* are formed on the cooling fins 50, parallel to the cylinder axis C, through which the branch pipe 68 is disposed, can be adopted, as shown in FIG. 20(*b*).

In FIG. 20(*a*) and FIG. 20(*b*), reference numerals 50*a'*, 50*b'* denote a recess and a through hole, respectively, for positioning the branch pipe 68', which are to be formed on the front cylinder block 17 if used as a rear cylinder block. The front cylinder block 17 and the rear cylinder block 18 are common parts.

To the cooling water discharge ports 52*d* of the front and rear cylinder heads 19, 20 are connected discharge pipes 69 through joints 69*a*, respectively, and to the exhaust pipes 69 is connected one joined pipe 70. An exhaust hose 72 is connected to the joined flow pipe 70 through a thermostat 71, and the downstream end of the exhaust hose 72 is connected to the cooling water inlet 54*b* of the radiator 54. The thermostat 71 is disposed under the fuel tank 6 in the V-bank and adapted to establish communication between the joined flow pipe 70 and exhaust hose 72 when the temperature of cooling water reaches a setting value and an opening/closing valve 71*a* is opened.

The motor-driven pump 55 is disposed in the vicinity of and parallel to the thermostat 71 and provided with an electric motor (not shown) drive-controlled by a controller (not shown) using a battery 56, disposed below the seat 7, as a power source. A suction port 55*a* of the motor-driven pump 55 is connected to the upstream side of the opening/closing valve 71*a* of the thermostat 71. A delivery port 55*b* is connected to the suction port 53*c* of the water pump 53 through a circulation pipe 73.

To the cooling water filler port 54*d* of the radiator 54 is connected a filler hose 74 and to the filler hose 74 is connected a filler cap 75 provided in a gusset in front of the fuel tank 6. To the filler cap 75 is connected a recovery hose 76 and the recovery hose 76 is connected to the bottom of a recovery tank 77 provided under the battery 56.

To the recovery tank 77 is connected a recovery filler port 77*a* provided under the seat 7, through a filler hose 77*b*.

The partial water cooling system of this embodiment is operated as follows. When a main switch (not shown) is turned on and the engine 15 is started, the crankshaft 21 rotates, causing the mechanical pump 53 to rotate. When the temperature of the cooling water in the cooling jacket 52, in the thermostat 71, to be exact, exceeds a given value, the thermostat 71 is opened and the cooling water is circulated between the cooling jacket 52 and radiator 54.

When the main switch is turned off, the engine 15 stops, causing the mechanical pump 53 to stop. Then, the motor-driven pump 55 is started by power from the battery 56, the cooling water in the cooling jacket 52 is circulated through the discharge pipe 69, joined flow pipe 70, circulation pipe 73 and supply pipe 66. The radiator 54 is bypassed and the motor is stopped after a lapse of a given time (see FIG. 8 and FIG. 13).

In the cooling structure of this embodiment, the annular cooling jacket 52 is formed, passing through the front and rear cylinder heads 19, 20 between the jointed flow intake ports 19*d*, 20*d* as well as jointed flow exhaust ports 19*e*, 20*e*, and the lower mating surfaces 19*f*, 20*f*, and surrounding the peripheral portions of the combustion chambers 19*a*, 20*a*, for the circulation of cooling water between the cooling jacket 52 and radiator 54. Therefore, the region around the combustion chambers 19*a*, 20*a* subject to a particularly high heat load can be partially cooled with the cooling water, while mainly utilizing air-cooling, thereby securing engine cooling performance necessary to an air-cooled engine of a large displacement, whose bore diameter exceeds 100 mm.

The overhang portion 19*f'* is formed at the end of the cylinder head 19 on the cylinder block side and the branch pipe (water pipe) 68 is connected to the water port 52*c* formed in the overhang portion 19*f'* while being disposed approximately in parallel to the cylinder axis C. This prevents the branch pipe 68 from protruding outward of the engine and allows the water supply with a simple and compact structure although the cooling jacket is not provided on the cylinder block but only on the cylinder head. The appearance of the branch pipe 68 of this embodiment looks like a cover pipe for housing the push rods so that it neither stands out nor deteriorates the external appearance of the engine.

The branch pipe 68 is disposed close to the cylinder axis C such that part of the pipe is positioned within the recesses 50*a* formed on the cooling fins 50. This can more reliably prevent the branch pipe 68 from protruding outward of the engine.

The cooling jacket 52 is formed only in the peripheral portions of the combustion chambers 19*a*, 20*a*, so that cooling water capacity can be decreased to a value as small as 60 cc, and the size reduction and the weight saving of the radiator 54 and mechanical pump 53 can be effected that much. As a result, the size increase as well as the weight increase of the engine due to the additional partial water cooling system can be suppressed and the degree of freedom in designing of the engine and body can be secured.

In this embodiment, a structure is adopted in which the partial water cooling system is provided with the mechanical pump 53 driven for rotation by the engine 15 and the motor-driven pump 55 for circulating cooling water in the cooling jacket for a given time when stoppage of the engine causes the mechanical pump 53 to stop. Therefore, the cooling performance required in a high speed and high load operating range can be secured with a small amount of cooling water while preventing boiling of the cooling water at the time the engine stops.

It may be possible that circulation of the cooling water while the engine operates and the engine stops is performed entirely by the motor-driven pump 55. In this case, however, it is necessary for the motor-driven pump to provide a required amount of cooling water circulation in a high speed and high load operating range of the engine, resulting in a large and heavy electric motor.

The function required by the motor-driven pump 55 in this embodiment is satisfied if only cooling water in the cooling jacket 52 is circulated for a certain time when the engine stops so that a small pump of small capacity can be of use. In addition, since in this embodiment, the motor-driven pump 55 is utilized as an auxiliary and arranged such that it bypasses the radiator 54, it doesn't act as a water flow resistance in the main path. Further, no large flow rate is required for the passage related to the motor-driven pump, so that the diameter of the passage can be decreased and the cooling water rarely flows to the motor-driven pump as a bypass during the normal operation of the engine.

The electric motor 35 can be placed, directly or through a bypass, in the middle of the main path passing through the radiator 54.

Further, in this embodiment, the radiator 54 is disposed in front of the left and right down tubes 2*a* of the body frame 2 such that the upper header 54*a* of the radiator 54 is positioned at a height corresponding to the lower end of the cylinder block 18. Therefore, the blocking of the wind to the engine 15 by the radiator 54 can be prevented, securing air-cooling performance.

Figure 22:
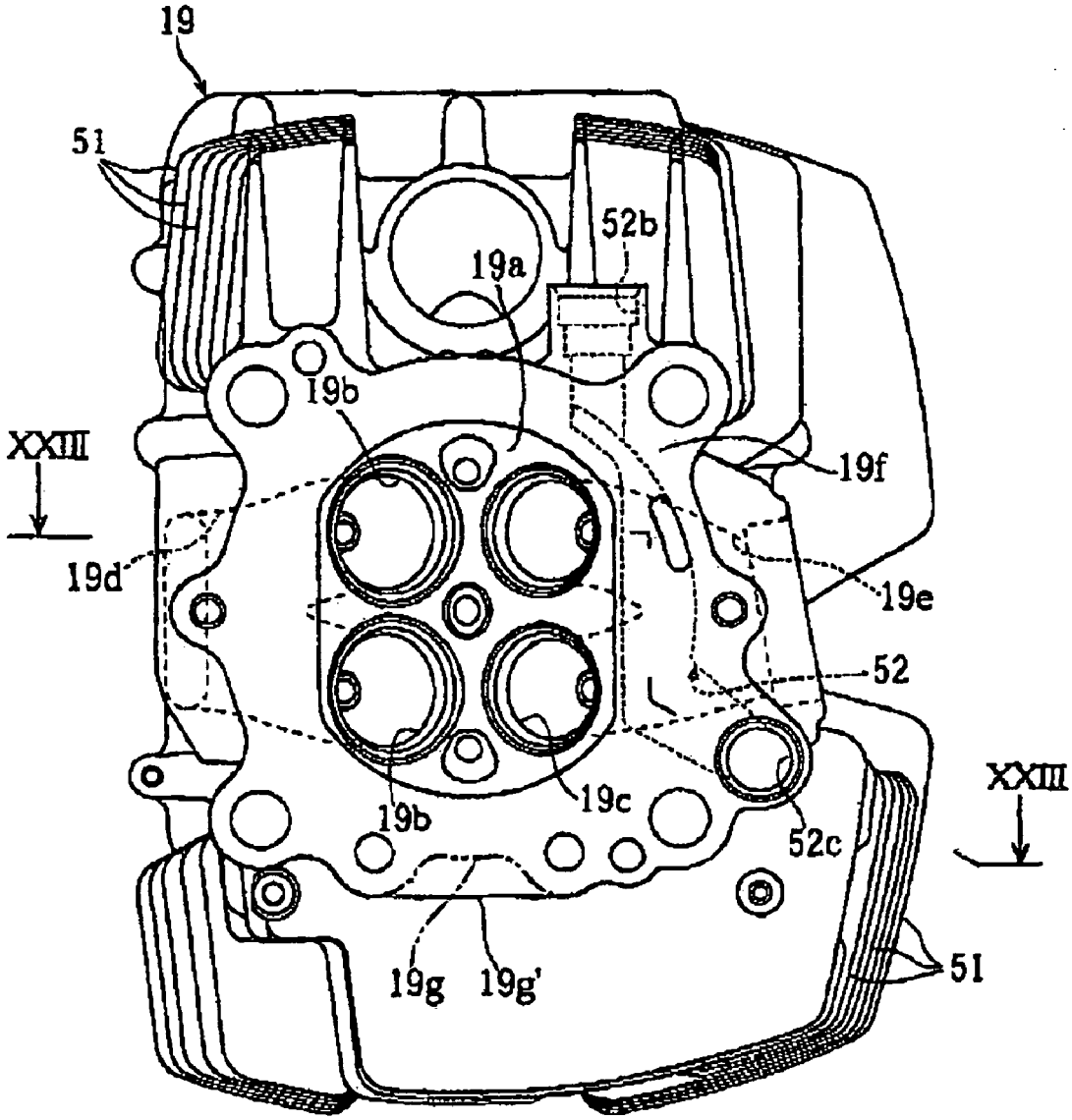
FIG. 22 is a bottom view of a cylinder head according to another embodiment of this invention.
Figure 23:
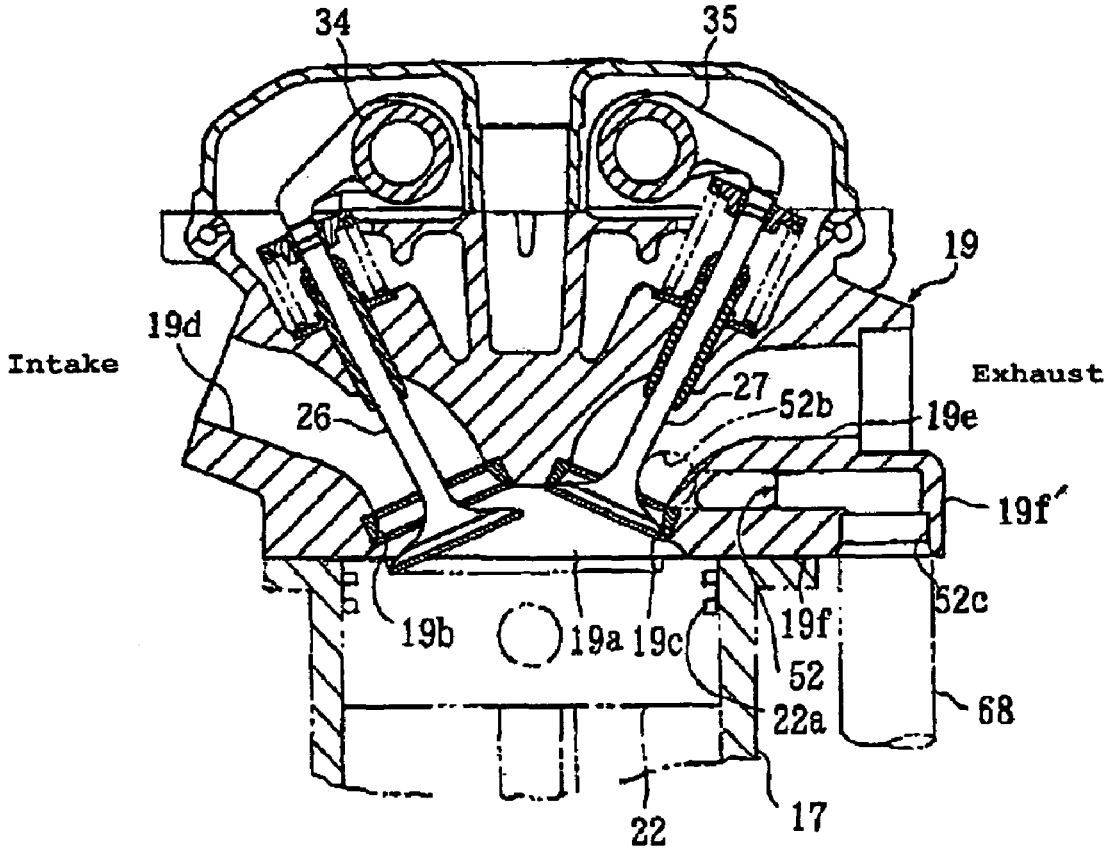
FIG. 23 is a sectional view taken along the line XXIII-XXIII of FIG. 22.

In the cooling structure of the foregoing embodiment, a case, where a cooling jacket 52 is formed passing under the intake and exhaust ports and surrounding the peripheral portion of the combustion recess, has been described, as an example. However, this invention is not limited to that. As shown in FIG. 22 and FIG. 23, the cooling jacket 52 may be formed in the cylinder head 19 between the jointed flow exhaust port 19*e* and the lower mating surface 19*f* and only in a region corresponding to the exhaust valve opening 19*c*. In these figures, reference numerals, which are the same as in FIG. 11 and FIG. 12, designate the same or equivalent parts.

In this case, only a region around the exhaust port 19*e* subject to the highest heat load is cooled, so that the capacity of the cooling jacket 52 can be further decreased to about 35 cc, thereby suppressing the size increase of the engine and securing the degree of freedom in designing.

Further, as shown in FIG. 22, a thick portion 19*g*' may be formed to fill the recessed portion in the right wall 19*g* of the cylinder head 19. This allows heat in the intake side to be transmitted easily to the cooling jacket 52 through the thick portion 19*g*', effecting a higher cooling efficiency.

Figure 24:
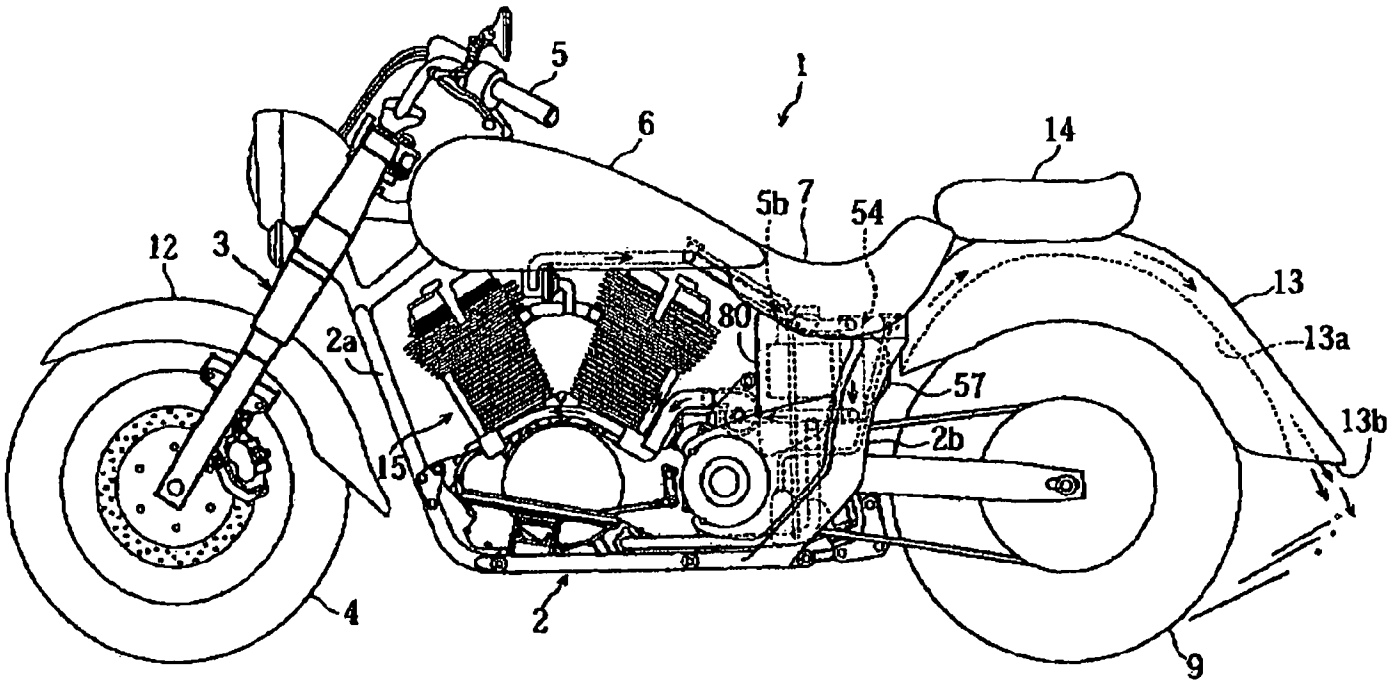
FIG. 24 is a view showing an arrangement of a radiator according to another embodiment of the present invention.

In the foregoing embodiment, the case, where the radiator 54 is disposed at the lower forward end of the body frame 2, has been described. However, this invention is not limited to that. As shown in FIG. 24, the radiator 54 may be disposed under the seat 7. In this case, vehicle components are preferably disposed around the radiator 54. More specifically, an oil tank 80 and the battery 56 may be disposed parallel to each other in front of the radiator 54 at the left and right sides. The rear wheel 9 and rear fender 13 may be disposed behind the radiator and further, the left and right rear arm brackets 2*b*, 2*b* of the body frame 2 may be disposed at the left and right sides of the radiator 54. In the figure, reference numerals, which are the same as in FIG. 1, designate the same or equivalent parts.

As described above, the radiator 54 is disposed under the seat 7, with the front of the radiator 54 surrounded by the oil tank 80 and battery 56, the rear of the radiator surrounded by the rear wheel 9 and rear fender 13, and the left and right sides surrounded by the rear arm brackets 2*b*. Therefore, the radiator 54 can be disposed in an inconspicuous location. In other words, the radiator can be disposed in a location where its presence is not recognized easily, improving the external appearance of the air-cooled engine.

Furthermore, a duct 13*a* may be formed along the inside surface of the rear fender 13, with an upstream port 13*c* opened facing the fan 57 of the radiator 54 and a downstream port 13*b* opened facing the ground so that the cooling wind from the cooling fan 57 of the radiator 54 is discharged to the ground through the duct 13*a*. In this case, water splashing caused by the rear wheel 9 can be suppressed by the cooling wind discharged from the duct 13*a*, preventing muddy water from sticking to the inner side of the rear fencer 13.

Regarding the crankshaft 21, the left and right crank journals 21*c* are supported by bosses 16*c* formed in the left and right walls of the crankcase section 16*a*. On the crankshaft 21 is mounted, at the left end, a generator 83 through a starter gear 82, and at the right end is fixed a crank gear 85 by key fitting.

The transmission mechanism is disposed in the mission case section 16*b* of the crankcase 16, which includes a main shaft 87 having an input gear group 89, a drive shaft 88 having an output gear group 90 meshing the input gear group 89, and a shift drum 93 for guiding and supporting an input side shift fork 91 engaged with the input gear group 89 and two output side shift forks 92 engaged with the output gear group 90, each disposed parallel to the crankshaft 21. The input side shift fork 91 and output side shift forks 92 are supported by fork shafts 91*a*, 92*a*, 92*b* for movement in the axial direction.

A foot-operated shift lever 94 (see FIG. 8) is operated in a swinging manner, causing the shift drum 93 to rotate and the shift forks 91, 92 to move axially to connect any specified gears of the input and output gear groups 89, 90 to the main shaft 87 and drive shaft 88, so that switching is performed between the lowest and the highest speed.

The left end portion of the drive shaft 88 protrudes outward from the mission case section 16*b* and an unillustrated drive sprocket mounted on the protruding drive shaft 88 is connected to a follower sprocket 93*a* of the rear wheel 9 through a drive belt 93 (see FIG. 1).

A clutch mechanism 95 is provided at the right end of the main shaft 87. The clutch mechanism 95 includes an outer drum 96 mounted on the main shaft 87 for relative rotation, an inner drum 97 coupled to the main shaft 87 for rotation therewith, and numerous clutch plates 98 disposed between the outer and inner drums 96, 97. In the clutch mechanism 95, a push rod 99 inserted in the center of the main shaft 87 is advanced and retracted by a hydraulic piston 100*a* of a hydraulic cylinder member 100, to transmit or cut off engine power to the main shaft 97.

Now, the balancer structure of the engine 15 will be described with reference mainly to FIG. 3, FIG. 4, FIG. 6 and FIG. 7.

First and second balancer shafts 105, 106 are disposed, parallel to the crankshaft 21, in front of, and behind the crankshaft 21, respectively. The first and second balancer shafts 105, 106 are formed with weights 105*a*, 106*a* integrally and the balancer shafts 105, 106 are supported by the bosses 16*c* formed on the left and right walls of the crankcase section 16*a* through bearings 107, 108.

A first balancer gear 109 is fixed to the first balancer shaft 105 at the right end, and a second balancer gear 110 is fixed to the second balancer shaft 106 at the right end, each by key fitting. The first and second balancer gears 109, 110 mesh the crank gear 5 and the first and second balancer shafts 105, 106 are rotated at the same speed as the crankshaft 21 in the direction opposite to the rotation of the crankshaft 21.

The right end portion of the second balancer shaft 106 is formed with an extension 106*b* and a boss 110*a* formed on the second balancer gear 110 as its extension is fitted on the extension 106*b*. On the boss 110*a* and outside the second balancer gear 110 is mounted a counter gear 111 of the same diameter as the second balancer gear for relative movement, and the counter gear 111 is meshed with a large reduction gear 112 mounted on the main shaft 87 for relative rotation. Reference numeral 111*a* designates a scissors gear for absorbing the backlash between the counter gear 111 and the large reduction gear 112. As such, the extension 106*b* and thus the second balancer shaft 106 are also used as a counter shaft. The large reduction gear 112 is coupled to the outer drum 96 through a rubber damper 113.

A disc spring type torque damper 115 is provided outside the counter gear 111 of the second balancer gear 110. The torque damper 115, as shown in FIG. 7, is disposed on the downstream side of the engine power transmission path to the second balancer gear 110 of the second balancer shaft 106.

The torque damper 115 is constituted such that outside a lifter 116 formed with a projection 116*a* to be engaged with a recess 111*a* of the counter gear 111 is provided a pair of leaf springs 117 for pushing the lifter 116 and biasing it toward the counter gear 111, and outside the leaf springs 117 is disposed a spring receiving member 118.

The lifter 116 and spring receiving member 118 are spline-fitted on the boss 110*a* of the second balancer gear 110 for rotation with the second balancer gear 110 and for axial movement. The spring receiving member 118 is restricted for its outward movement in the axial direction by a cotter fitted in the boss 110*a*. When torque variations occur in the crankshaft 21 and excessive torque is transmitted to the counter gear 111, the lifter 116 moves axially outwardly against the biasing force of the leaf springs 117, causing a sliding movement of the counter gear 111 on the boss 110*a*, resulting in damping of the torque variations.

In this case, since the torque damper 115 is disposed on the downstream side of rotation transmission of the crankshaft 21 to the second balancer shaft 106, the foregoing sliding movement doesn't change the phase angle of the balancer shaft 106 and the function as a balancer is not hindered.

Now, the positional relation between the crankshaft 21, the first and second balancer shafts 105, 106, the main shaft 87, the drive shaft 88 and the shift drum 93 of the engine 15 will be described with reference mainly to FIG. 3.

The first balancer shaft 105 is disposed in front of a normal plane to the axis of the crankshaft 21 and above a horizontal line A passing through the center of the crankshaft 21, and the second balancer shaft 106 is disposed behind said normal plane and below said horizontal line A.

The main shaft 87 is disposed further rearward and further upward than the second balancer shaft 106, and the drive shaft 88 is disposed downward and rearward of the main shaft 87 and approximately on the horizontal line A. The shift drum 93 is disposed between the second balancer shaft 106 and the main shaft 87, that is, in front of the main shaft 87, and below the horizontal line A.

In the balancer structure of this embodiment as described above, a first balancer shaft 105 is disposed in front of a normal plane to the axis of the crankshaft 21, and a second balancer shaft 106 is disposed behind the normal plane. On the extension 106*b* of the second balancer shaft 106 is provided a counter gear 111 for transmitting the rotation of the crankshaft 21 to the main shaft 87. Therefore, the second balancer shaft 106 can be used as a counter shaft, and the longitudinal length of the crankcase 16 can be decreased by eliminating the amount corresponding to the space occupied by the counter shaft.

In this embodiment, a counter gear 111 and a disc spring type torque damper 115 are provided on the downstream side from the second balancer gear 110 fixed to the second balancer shaft 106. Therefore, the phase shift of the second balancer shaft 106 can be prevented at the time of the activation of the torque damper 115.

The main shaft 87 is disposed behind and above the second balancer shaft 106, and the shift drum 93 between the main shaft 87 and second balancer shaft 106, that is, in front of the main shaft 87. Therefore, the drive shaft 88 can be disposed closer to the crankshaft 21 compared with the prior art in which the shift drum is disposed behind the main shaft, and the longitudinal length of the crankcase 16 can be decreased.

In this embodiment, the first balancer shaft 105 is disposed above the horizontal line A passing through the center of the crankshaft 21, and the second balancer shaft 106 below the horizontal line. Therefore, the horizontal distance between the first and second balancer shafts 105, 106 on both sides of the crankshaft 21 can be decreased and thus the longitudinal length of the crankcase 12 can be decreased as well.

Now, a lubrication device of the engine 15 will be described with reference mainly to FIG. 14-FIG. 20.

The lubrication device of this embodiment is provided, as shown in FIG. 21, with a transmission lubrication system 126 for supplying lubricant in the oil tank 80 to the transmission by an oil feed pump 124*c*, and an engine lubrication system 127 for supplying oil to the engine, and the engine lubrication system 127 is branched into a cam lubrication system 127*a* and a cylinder lubrication system 127*b*. In these lubrication systems, lubricant falls into the oil sump 16*e* at the bottom of the crankcase 16 and is drawn up from the reservoir by oil scavenging pumps 124*a*, 124*b* to be returned to the oil tank 80.

In the transmission lubrication system 126, lubricant is supplied from the main shaft to the input gear group and the clutch mechanism, to the drive shaft and the shift fork through a mission shower, and thereafter to the output gear group.

In the cam lubrication system 127*a*, lubricant is supplied from a right crank journal to left front and rear cam journals, a front connecting rod large end and a hydraulic tensioner in a branched manner. The lubricant supplied to the left front cam journal is supplied from a front hydraulic lifter and a right front cam journal to a front rocker arm through a front push rod. The lubricant supplied to the left rear cam journal is supplied from a rear hydraulic lifter and a right rear cam journal to a rear rocker arm through a rear push rod. The lubricant supplied to the front connecting rod is supplied to a front piston.

In the cylinder lubrication system 127*b*, lubricant is supplied from a left crank journal to the front and rear cylinder heads, an ACM coil, a rear connecting rod large end and a starter one way in a branched manner. The lubricant supplied to the front and rear cylinder heads is supplied separately to front and rear valve stem ends and the lubricant supplied to the rear connecting rod is supplied to a rear piston. The lubricant falls to the bottom of the crankcase through unillustrated passages after lubricating moving parts.

An oil filter 130 is mounted detachably to the lower end of a rear wall 16*d* of the crankcase 16. The oil filter 130 is constituted such that an oil element 131 is provided in a filter chamber 130*a* and the filter chamber 130*a* is divided into an oil inflow chamber 130*b* and an oil outflow chamber 130*c* by the oil element 131. The oil inflow chamber 130*b* is in communication with an inflow passage 16*f* formed on the rear wall 16*d* and the oil inflow chamber 130*c* is in communication with an outflow passage 16*g* formed on the rear wall 16*d*.

To the outflow passage 16*g* of the rear wall 16*d* is connected a main gallery 128. The main gallery 128 is in communication with left and right crank journals 21*c*. In the crankcase 16 is formed a mission passage 129 in communication with the upstream end of the main gallery 128, and the mission passage 129 is in communication with a boss 87*a* supporting the right end of the main shaft 87.

The oil scavenging pumps 124*a*, 124*b* and an oil pump 125 acting as the oil feed pump 124*c* are disposed under the shift drum 93 in the crankcase 16. The oil pump 125 has a housing 125*a* fixed to the inner side of a right wall 16*h* of the crankcase 16, and a pump shaft 125*b* inserted for rotation in the housing 125*a* and disposed parallel to the crankshaft 21. A pump gear 133 is mounted to the left end portion of the pump shaft 125*b* protruding from the housing 125*a*. The pump gear 133, as shown in FIG. 6, meshes a drive gear 134 mounted on the left end of the second balancer shaft 106 through a middle gear 135 so that rotation of the crankshaft 21 causes the pump shaft 125*b* to rotate.

As shown in FIG. 16, first and second pump chambers 136*a*, 136*b* acting as the oil scavenging pumps 124*a*, 124*b* and a third pump chamber 136*c* acting as the oil feed pump 124*c* are formed, separate from each other, around the pump shaft 125*b* in the housing 125*a*. First, second and third rotors 137*a*, 137*b*, 137*c* mounted on the pump shaft 125*b* are provided in the pump chambers 136*a*-136*c*, respectively.

A suction passage 138*a* is formed on the upstream side of the third pump chamber 136*c* in the housing 125*a*, and a delivery passage 138*b* is formed on the downstream side. To the suction passage 138*a* is connected a downstream end of an oil feed pipe 132 connected to the oil tank 80. Also, the oil inflow chamber 130*b* of the oil filter 130 is connected to the delivery passage 138*b*, with a check valve 139 for preventing back flow of the lubricant placed therebetween.

First and second collection passages 140*a*, 140*b* are formed independently on the upstream side of the first and second pump chambers 136*a*, 136*b* in the housing 125*a*, respectively, and a joined flow passage 140*c* is formed on the downstream side. An oil return pipe 141 is connected to the joined flow passage 140*c*, and the downstream end of the oil return pipe 141 is connected to the oil tank 80.

An approximately flat oil sump 16*e* is formed at the bottom of the crankcase 16. Inside the crankcase 16 is formed an arcuate partition wall 16*i* surrounding the lower part of the rotation locus of the crank arm 21*b*, and at the forward end of the partition wall 16*i* is formed a cutout 16*j* extending over the entire width. The partition wall 16*i* serves as a means of preventing lubricant from being stirred up in the oil sump 16*e* due to rotational movement of the crankshaft 21. The cutout 16*j* is an opening through which lubricant splashed by the crankshaft 21 is returned to the oil sump 16*e*.

Here, the partition wall 16*i* is formed in an arcuate shape and the portion of the partition wall under the crankshaft is brought close to the bottom of the crankcase 16. Therefore, the oil sump 16*e* in this embodiment can be considered as being divided substantially into a front portion 16*e*' and a rear portion 16*e*" on both sides of the crankshaft 21.

Front and rear suction ports 142, 143 are provided in the front portion 16*e*' and rear portion 16*e*" of the oil sump 16*e* on both sides of the crankshaft 21, respectively. Here, the front portion 16*e*' and the rear portion 16*e*" of the oil sump 16*e* are portions where lubricant is likely to be swept in and accumulated due to pressure variations associated with the rotation of the crankshaft 21 and reciprocating movement of the piston, and the front and rear suction ports 142, 143 are disposed in such portions.

The rear suction port 143 is connected to the first collection passage 140*a* of the oil pump 125 integral therewith, which opens downward close to the bottom of the crankcase. A plate-like rear strainer 143 is provided in the rear suction port 143.

The front suction port 142 is formed under the partition wall 16*i* of the right wall 16*h* of the crankcase 16. A cylindrical front strainer 144 is inserted in the front suction port 142, and a drawing pipe 145 is connected to the strainer 144. The drawing pipe 145 is provided extending longitudinally outside the right wall 16*h*, and the downstream end of the drawing pipe 145 is connected to the second collection passage 140*b* of the oil pump 125. The drawing pipe 145, as shown in FIG. 17, is disposed below the crank arm 21*b* of the crankshaft 21 in a region offset from the crank arm 21*b* in the axial direction of the crankshaft.

A description will next be made of functions and effects of the embodiments of the present invention.

In the lubrication device of this embodiment, suction ports 142, 143 are disposed in the front portion 16*e*' and the rear portion 16*e*" of the oil sump 16*e* on both sides of the crankshaft 21. Therefore, lubricant can be collected reliably without accumulation even if it is dispersed forward and rearward of the oil sump 16*e*. As a result, the bottom of the crankcase 16 can be elevated, the engine height can be suppressed that much, and the problem of accumulation of lubricant can be resolved when the engine displacement is increased, for example, to 1000 cc or larger.

In this embodiment, the suction ports 142, 143 are disposed in the front portion 16*e*' and the rear portion 16*e*" of the oil sump 16*e*, which means that they are disposed in locations where lubricant is most likely to be accumulated. Therefore, collection efficiency of the lubricant is enhanced.

In this embodiment, on the pump shaft 125*b* of the oil pump 125 are mounted first and second rotors 137*a*, 137*b* for sucking lubricant from the suction ports 142, 143, and a third rotor 137*c* for delivering lubricant in the oil tank 80. Therefore, if one oil pump 125 is only disposed in the crankcase 16, the pump is allowed to act as two scavenging pumps 124*a*, 124*b* and one oil feed pump 124*c*, preventing the size increase of the lubrication system.

Figure 25:
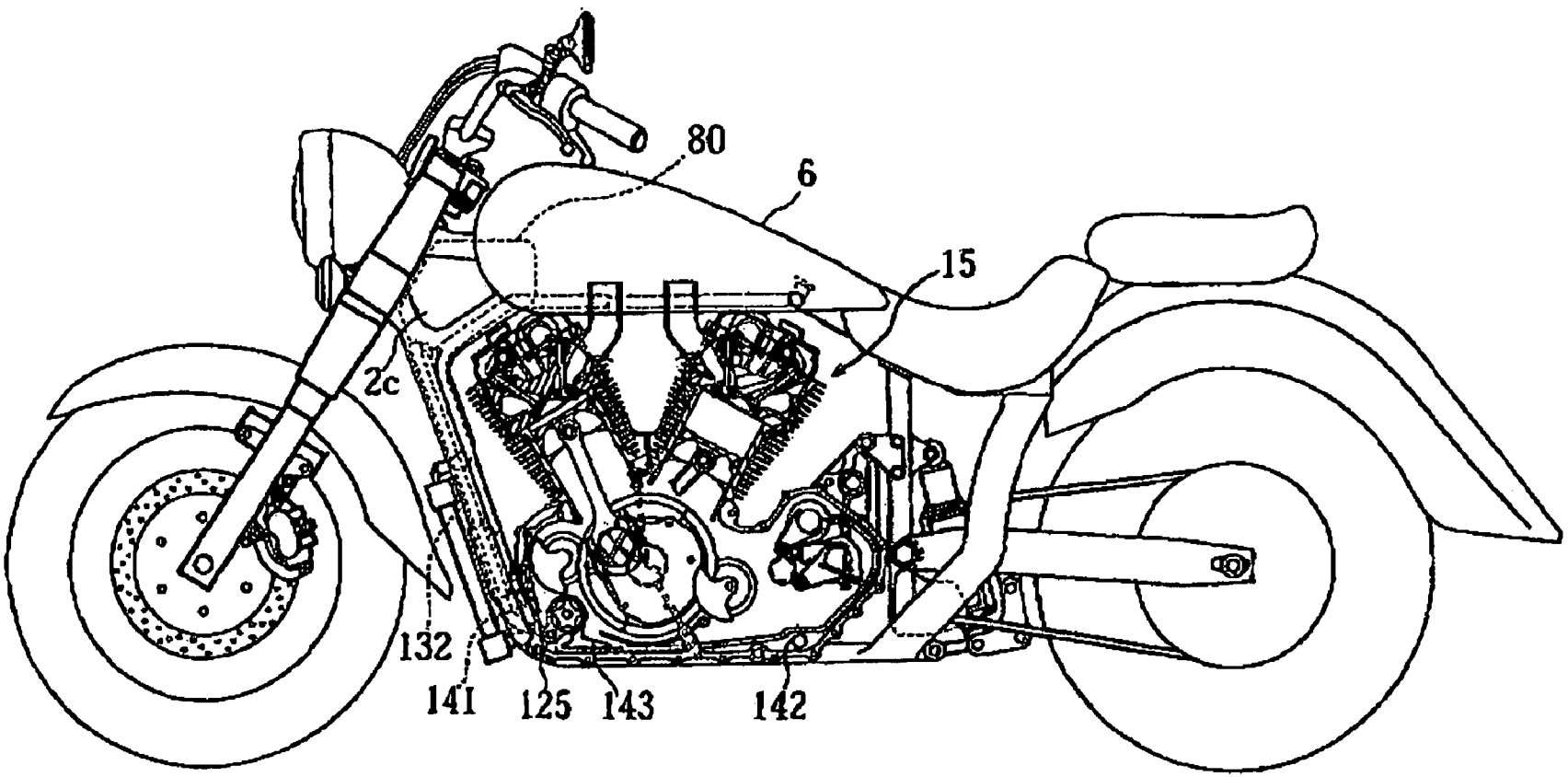
FIG. 25 is a view showing an arrangement of an oil tank according to still another embodiment of the present invention.

In the foregoing embodiment, a case, where an oil tank 80 is disposed under the seat, has been described. However, this invention is not limited to that. As shown in FIG. 25, the oil tank 80 may be disposed in a space behind the head pipe (not shown) and surrounded by the gusset 2*c* and the fuel tank 9. In this case, the oil pump 125 may be disposed at the forward end of the bottom of the crankcase.

In this case, the oil tank 80 is disposed by utilizing a vacant space at the front of the body frame 2, and the piping distance between the oil tank 80 and oil pump 125 can be decreased compared with when the oil tank is disposed under the seat, simplifying the lubrication path.

What is claimed is:

1. A four-stroke engine comprising:

a cylinder block;

a cylinder head mounted on the cylinder block;

multiple cooling fins formed on the cylinder block and the cylinder head;

a combustion chamber; and an intake port and exhaust port formed in the cylinder head and in communication with the combustion chamber, wherein a cooling jacket is formed in the cylinder head only between a virtual object generated by the intake port or exhaust port being rotated about a cylinder axis, and a mating surface of the cylinder head on the cylinder block, the cooling jacket being formed only between a bottom surface of the exhaust port and the mating surface on the cylinder block, and surrounding an outer peripheral portion of the combustion chamber viewed in a cylinder axis direction, and wherein the cooling jacket comprises a cooling water supply port and a cooling water discharge port that are disposed in direct opposition to each other when viewed in the cylinder axis direction.

2. The four-stroke engine according to claim 1, wherein the cylinder head has an overhang portion formed at an end on the cylinder block and protruding outward from a cylinder of the cylinder block in a radial direction of the cylinder, the overhang portion has a water port for the cooling jacket formed on its undersurface, the water port is connected to a water pipe, and the water pipe is disposed approximately in parallel to the cylinder axis.

3. The four-stroke engine according to claim 2, wherein the water pipe is disposed close to the cylinder axis such that part of the water pipe is positioned within the cooling fin.

4. The four-stroke engine according to claim 1, wherein a mechanical pump driven for rotation by a crankshaft circulates cooling water between the cooling jacket and a radiator during an engine operation, and a motor-driven pump circulates cooling water in the cooling jacket for a given time at a time the engine stops.

5. The four-stroke engine according to claim 4, wherein cooling water in the cooling jacket is circulated such that it bypasses the radiator at the time the engine stops.

6. The four-stroke engine according to claim 5, wherein the radiator is disposed such that an upper end portion of the radiator is positioned at a height corresponding to a lower end of the cylinder block when viewed from a front of a vehicle.

7. The four-stroke engine according to claim 5, wherein the radiator is disposed under a seat of a motorcycle, and vehicle components are disposed in front and rear of as well as on a left and right side of the radiator.

8. A four-stroke engine comprising:

a cylinder block;

a cylinder head mounted on the cylinder block;

a combustion chamber;

an intake port and exhaust port formed in the cylinder head and in communication with the combustion chamber, a cooling jacket formed only between a bottom surface of the exhaust port and a mating surface on the cylinder block, and surrounding an outer peripheral portion of the combustion chamber viewed in a cylinder axis direction, wherein the cooling jacket comprises a cooling water supply port and a cooling water discharge port that are disposed in direct opposition to each other when viewed in the cylinder axis direction;

a radiator; and circulating cooling water between the cooling jacket and the radiator, wherein a mechanical pump driven for rotation by a crankshaft circulates the cooling water between the cooling jacket and the radiator during an engine operation, and a motor-driven pump circulates the cooling water in the cooling jacket for a given time at a time the engine stops.

9. The four-stroke engine according to claim 8, wherein the cooling water in the cooling jacket is circulated such that it bypasses the radiator at the time the engine stops.

10. The four-stroke engine according to claim 8, wherein the cylinder head has an overhang portion formed at an end on the cylinder block and protruding outward from a cylinder of the cylinder block in a radial direction of the cylinder, the overhang portion has a water port for the cooling jacket formed on its undersurface, the water port is connected to a water pipe, and the water pipe is disposed approximately in parallel to the cylinder axis.

11. A method for manufacturing a four-stroke engine, comprising:

providing a cylinder block, a cylinder head mounted on the cylinder block and a combustion chamber;

forming an exhaust port in the cylinder head in communication with the combustion chamber;

providing a cooling jacket and radiator;

surrounding an outer peripheral portion of the combustion chamber with the cooling jacket and disposing the cooling jacket entirely between a bottom surface of the exhaust port and a mating surface of the cylinder block, wherein the cooling jacket comprises a cooling water supply port and a cooling water discharge port that are disposed in direct opposition to each other when viewed in the cylinder axis direction;

circulating cooling water between the cooling jacket and the radiator;

driving a mechanical pump for rotation by a crankshaft circulating the cooling water between the cooling jacket and the radiator during an engine operation; and circulating the cooling water in the cooling jacket for a given time at a time the engine stops.

12. The method according to claim 11, further comprising circulating the cooling water in the cooling jacket such that it bypasses the radiator at the time the engine stops.

13. The method according to claim 11, further comprising disposing the radiator under a seat of a motorcycle.

14. The method according to claim 11, further comprising disposing a water pipe close to a cylinder axis such that the water pipe is positioned within a cooling fin.

* * * * *